United States Patent [19]

Ishizaka

[11] Patent Number: 4,769,635

[45] Date of Patent: Sep. 6, 1988

[54] GRAPHIC DISPLAY CONTROL METHOD AND APPARATUS

[75] Inventor: Masaaki Ishizaka, Yokohama, Japan

[73] Assignee: Matsushita Electric Industrial Co., Ltd., Osaka, Japan

[21] Appl. No.: 136,421

[22] Filed: Dec. 15, 1987

Related U.S. Application Data

[63] Continuation of Ser. No. 621,564, Jun. 18, 1984, abandoned.

[30] Foreign Application Priority Data

Jun. 20, 1983 [JP] Japan ..... 58-111266
Dec. 23, 1983 [JP] Japan ..... 58-246075

[51] Int. Cl.[4] ..... G09G 1/16

[52] U.S. Cl. ..... 340/723; 340/728; 340/703; 340/747

[58] Field of Search ..... 340/728, 723, 744, 747, 340/701, 703; 358/284

[56] References Cited

U.S. PATENT DOCUMENTS 4,095,216 6/1978 Spicer ..... 340/728
4,354,186 10/1982 Groothuis ..... 340/728
4,371,872 2/1983 Rossman ..... 340/723
4,425,559 1/1984 Sherman ..... 340/703
4,481,509 11/1984 Sasaki et al. ..... 340/703
4,544,922 10/1985 Watanabe et al. ..... 340/728
4,642,623 2/1987 Dureux ..... 340/728

OTHER PUBLICATIONS

J. G. Axford, IBM Technical Disclosure Bulletin, Interleaved Smoothing Raster for Vector CRT Displays vol. 19, No. 11, Apr. 1977.

*Primary Examiner*—Gerald L. Brigance
*Assistant Examiner*—Jeffery A. Brier
*Attorney, Agent, or Firm*—Spencer & Frank

[57] ABSTRACT

A graphic display control method and apparatus wherein illumination of pixels on a display screen of an interlace type CRT in a first field and a second field is controlled so that each point on a line is displayed on the display screen of the interlace type CRT by a combined illumination of a pixel in the first field and the second field or a combined illumination of one of two vertically adjacent pixels in the first field or the second field and the second pixel in the second field or the first field. The smooth line is displayed by a series of points.

27 Claims, 24 Drawing Sheets

FIG. 1
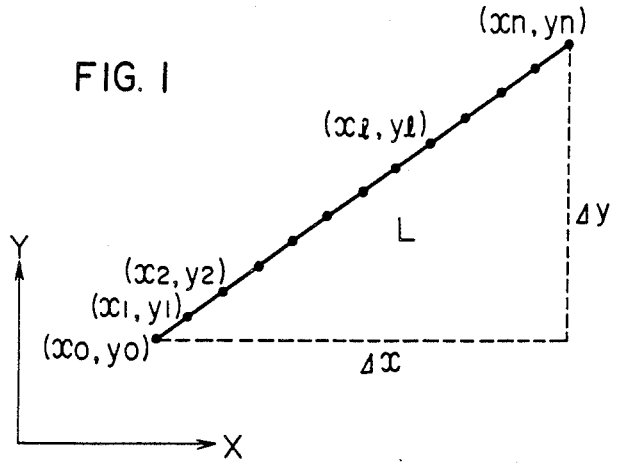
FIG. 3
| M | (AXIS) | X ADDRESS | Y ADDRESS | ILLUMINATION CONTROL DATA | FRAME MEMORY |
|---|---|---|---|---|---|
| 0 | 0 | Xℓ | Yℓ | 0 | Xℓ [0] Yℓ |
| 1 | 0 | Xℓ | Yℓ | 1 | Xℓ [2] Yℓ+1 [1] Yℓ |
| | | Xℓ | Yℓ+1 | 2 | |
| 0 | 1 | Xℓ | Yℓ | 0 | Xℓ [0] Yℓ |
| 1 | 1 | Xℓ | Yℓ | 3 | Xℓ [3] Yℓ |
FIG. 4
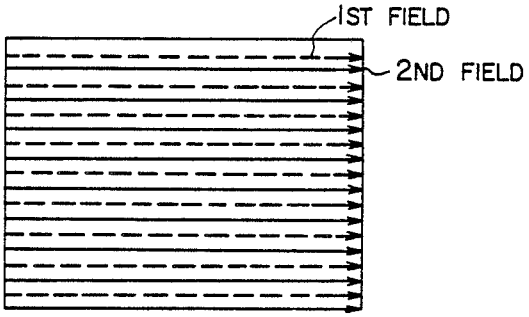

CRT
23
SHIFT
22
GATE
21
ILLUMINATION CONTROL
20
ADDRESS SIG. GEN.
19
2
4X
3X
7X
6X
5X
REGISTER
+1 (Δx/Δy)
x0
OUTx
10X
(5X)
X AD-DRESS
14
COLOR DATA
FRAME MEMORY
ILLUMINATION CONTROL DATA
Y ADDRESS
MULTIPLEXER
12
OUTy
10Y
(5Y)
7Y
6Y
5Y
4Y
3Y
REGISTER
Δy/Δx (+1)
y0
+1
11
9
(6Y)
(6X)
17
CONTROL
13
(M)
COMPARATOR
MULTIPLEXER
8
0.5≧
18
ILLUMINATION CONTROL DATA
16
REGISTER
DATA GENERATOR
15
(AXIS)
COMPARATOR
1
Δx
Δy
COLOR DATA

| POINT | X, Y, COORDI-NATES | OUTx | OUTy | M | (AXIS) | X ADDRESS | Y ADDRESS | ILLUMINATION CONTROL DATA |
|---|---|---|---|---|---|---|---|---|
| (x0, y0) | (1, 1) | 1 | 1 | 0 | 0 | 1 | 1 | 0 |
| (x1, y1) | (2, 1.25) | 2 | 1 | 0 | 0 | 2 | 1 | 0 |
| (x2, y2) | (3, 1.5) | 3 | 1 | 1 | 0 | 3 | 1 | 1 |
| | | | | | | | 2 | 2 |
| (x3, y3) | (4, 1.75) | 4 | 1 | 1 | 0 | 4 | 1 | 1 |
| | | | | | | | 2 | 2 |
| (x4, y4) | (5, 2) | 5 | 2 | 0 | 0 | 5 | 2 | 0 |
| (x5, y5) | (6, 2.25) | 6 | 2 | 0 | 0 | 6 | 2 | 0 |
| (x6, y6) | (7, 2.5) | 7 | 2 | 1 | 0 | 7 | 2 | 1 |
| | | | | | | | 3 | 2 |
| (x7, y7) | (8, 2.75) | 8 | 2 | 1 | 0 | 8 | 2 | 1 |
| | | | | | | | 3 | 2 |
| (x8, y8) | (9, 3) | 9 | 3 | 0 | 0 | 9 | 3 | 0 |

FIG. 8B

| POINT | X, Y COORDI-NATES | OUTx | OUTy | M | (AXIS) | X ADDRESS | Y ADDRESS | ILLUMINATION CONTROL DATA |
|---|---|---|---|---|---|---|---|---|
| (x0, y0) | (1, 1) | 1 | 1 | 0 | 1 | 1 | 1 | 0 |
| (x1, y1) | (1.25, 2) | 1 | 2 | 0 | 1 | 1 | 2 | 0 |
| (x2, y2) | (1.5, 3) | 1 | 3 | 1 | 1 | 1 | 3 | 3 |
| (x3, y3) | (1.75, 4) | 1 | 4 | 1 | 1 | 1 | 4 | 3 |
| (x4, y4) | (2, 5) | 2 | 5 | 0 | 1 | 2 | 5 | 0 |
| (x5, y5) | (2.25, 6) | 2 | 6 | 0 | 1 | 2 | 6 | 0 |
| (x6, y6) | (2.5, 7) | 2 | 7 | 1 | 1 | 2 | 7 | 3 |
| (x7, y7) | (2.75, 8) | 2 | 8 | 1 | 1 | 2 | 8 | 3 |
| (x8, y8) | (3, 9) | 3 | 9 | 0 | 1 | 3 | 9 | 0 |

| M | (AXIS) | X ADDRESS | Y ADDRESS | ILLUMINATION CONTROL DATA | FRAME MEMORY |
|---|---|---|---|---|---|
| 0 | 0 | Xℓ | Yℓ | 0 | Xℓ [0] Yℓ |
| 1 | 0 | Xℓ<br>Xℓ | Yℓ<br>Yℓ-1 | 1<br>2 | Xℓ [1] Yℓ<br>[2] Yℓ-1 |
| 0 | 1 | Xℓ | Yℓ | 0 | Xℓ [0] Yℓ |
| 1 | 1 | Xℓ | Yℓ | 3 | Xℓ [3] Yℓ |

FIG. 12

| POINT | X, Y COORDI-NATES | ROUNDED X, Y COORDINATES | M | (AXIS) | X ADDRESS | Y ADDRESS | ILLUMINATION CONTROL DATA |
|---|---|---|---|---|---|---|---|
| $(x_0, y_0)$ | (1, 1) | (1, 1) | 0 | 0 | 1 | 1 | 0 |
| $(x_1, y_1)$ | (2, 1.25) | (2, 1) | 0 | 0 | 2 | 1 | 0 |
| $(x_2, y_2)$ | (3, 1.5) | (3, 2) | 1 | 0 | 3 | 2 | 1 |
| | | | | | | 1 | 2 |
| $(x_3, y_3)$ | (4, 1.75) | (4, 2) | 1 | 0 | 4 | 2 | 1 |
| | | | | | | 1 | 2 |
| $(x_4, y_4)$ | (5, 2) | (5, 2) | 0 | 0 | 5 | 2 | 0 |
| $(x_5, y_5)$ | (6, 2.25) | (6, 2) | 0 | 0 | 6 | 2 | 0 |
| $(x_6, y_6)$ | (7, 2.5) | (7, 3) | 1 | 0 | 7 | 3 | 1 |
| | | | | | | 2 | 2 |
| $(x_7, y_7)$ | (8, 2.75) | (8, 3) | 1 | 0 | 8 | 3 | 1 |
| | | | | | | 2 | 2 |
| $(x_8, y_8)$ | (9, 3) | (9, 3) | 0 | 0 | 9 | 3 | 0 |

FIG. 15

| POINT | x , y COORDI-NATES | ROUNDED x , y COORDINATES | M | (AXIS) | X ADDRESS | Y ADDRESS | ILLUMINATION CONTROL DATA |
|---|---|---|---|---|---|---|---|
| ($x_0$,$y_0$) | (1 , 1) | (1 , 1) | 0 | 1 | 1 | 1 | 0 |
| ($x_1$,$y_1$) | (1.25 , 2) | (1 , 2) | 0 | 1 | 1 | 2 | 0 |
| ($x_2$,$y_2$) | (1.5 , 3) | (2 , 3) | 1 | 1 | 2 | 3 | 3 |
| ($x_3$,$y_3$) | (1.75 , 4) | (2 , 4) | 1 | 1 | 2 | 4 | 3 |
| ($x_4$,$y_4$) | (2 , 5) | (2 , 5) | 0 | 1 | 2 | 5 | 0 |
| ($x_5$,$y_5$) | (2.25 , 6) | (2 , 6) | 0 | 1 | 2 | 6 | 0 |
| ($x_6$,$y_6$) | (2.5 , 7) | (3 , 7) | 1 | 1 | 3 | 7 | 3 |
| ($x_7$,$y_7$) | (2.75 , 8) | (3 , 8) | 1 | 1 | 3 | 8 | 3 |
| ($x_8$,$y_8$) | (3 , 9) | (3 , 9) | 0 | 1 | 3 | 9 | 0 |

FIG. 22

| M | (AXIS) | G | X ADDRESS | Y ADDRESS | ILLUMINATION CONTROL DATA | 2ND MEMORY | COLOR CONTROL DATA | 1ST MEMORY |
|---|---|---|---|---|---|---|---|---|
| 0 | 0 | | Xℓ | Yℓ | 0 | Yℓ [0] Xℓ | 1 | Yℓ [C.D.] Xℓ |
| 1 | 0 | 0 | Xℓ | Yℓ | 3 | Yℓ+1 [3] Yℓ [3] Xℓ | 0 | Yℓ+1 [C.D.] Yℓ [ ] Xℓ |
| | | | Xℓ | Yℓ + 1 | 3 | | 1 | |
| | | 1 | Xℓ | Yℓ | 2 | Yℓ+1 [2] Yℓ [2] Xℓ | 1 | Yℓ+1 [ ] Yℓ [C.D.] Xℓ |
| | | | Xℓ | Yℓ + 1 | 2 | | 0 | |
| 0 | 1 | | Xℓ | Yℓ | 0 | Yℓ [0] Xℓ | 1 | Yℓ [C.D.] Xℓ |
| 1 | 1 | | Xℓ | Yℓ | 1 | Yℓ [1] Xℓ | 1 | Yℓ [C.D.] Xℓ |

FIG. 24B

| | X, Y COORDINATES | OUTX | OUTY | M | (AXIS) | X ADDRESS | Y ADDRESS | G | ILLUMINATION CONTROL DATA | COLOR CONTROL DATA |
|---|---|---|---|---|---|---|---|---|---|---|
| (x0,y0) | (1, 1) | 1 | 1 | 0 | 0 | 1 | 1 | 0 | 0 | 1 |
| (x1,y1) | (2,1.25) | 2 | 1 | 0 | 0 | 2 | 1 | 0 | 0 | 1 |
| (x2,y2) | (3, 1.5) | 3 | 1 | 1 | 0 | 3 | 1 | 0 | 3 | 0 |
| | | | | | | | 2 | 0 | 3 | 1 |
| (x3,y3) | (4,1.75) | 4 | 1 | 1 | 0 | 4 | 1 | 1 | 2 | 1 |
| | | | | | | | 2 | 1 | 2 | 0 |
| (x4,y4) | (5, 2) | 5 | 2 | 0 | 0 | 5 | 2 | 0 | 0 | 1 |
| (x5,y5) | (6, 2.25) | 6 | 2 | 0 | 0 | 6 | 2 | 0 | 0 | 1 |
| (x6,y6) | (7, 2.5) | 7 | 2 | 1 | 0 | 7 | 2 | 0 | 3 | 0 |
| | | | | | | | 3 | 0 | 3 | 1 |
| (x7, y7) | (8, 2.75) | 8 | 2 | 1 | 0 | 8 | 2 | 1 | 2 | 1 |
| | | | | | | | 3 | 1 | 2 | 0 |
| (x8,y8) | (9, 3) | 9 | 3 | 0 | 0 | 9 | 3 | 0 | 0 | 1 |

| POINT | X, Y COORDI-NATES | OUTx | OUTy | M | (AXIS) | X ADDRESS | Y ADDRESS | ILLUMINATION CONTROL DATA | COLOR CONTROL DATA |
|---|---|---|---|---|---|---|---|---|---|
| (x0,y0) | (1,1) | 1 | 1 | 0 | 1 | 1 | 1 | 0 | 1 |
| (x1,y1) | (1.25,2) | 1 | 2 | 0 | 1 | 1 | 2 | 0 | 1 |
| (x2,y2) | (1.5,3) | 1 | 3 | 1 | 1 | 1 | 3 | 1 | 1 |
| (x3,y3) | (1.75,4) | 1 | 4 | 1 | 1 | 1 | 4 | 1 | 1 |
| (x4,y4) | (2,5) | 2 | 5 | 0 | 1 | 2 | 5 | 0 | 1 |
| (x5,y5) | (2.25,6) | 2 | 6 | 0 | 1 | 2 | 6 | 0 | 1 |
| (x6,y6) | (2.5,7) | 2 | 7 | 1 | 1 | 2 | 7 | 1 | 1 |
| (x7,y7) | (2.75,8) | 2 | 8 | 1 | 1 | 2 | 8 | 1 | 1 |
| (x8,y8) | (3,9) | 3 | 9 | 0 | 1 | 3 | 9 | 0 | 1 |

FIG. 26C

| Y ADDRESS | X ADDRESS 0 | 1 | 2 | 3 | 4 |
|---|---|---|---|---|---|
| 9 | 0 | 0 | 0 | 0 | 0 |
| 8 | 0 | 0 | 1 | 0 | 0 |
| 7 | 0 | 0 | 1 | 0 | 0 |
| 6 | 0 | 0 | 0 | 0 | 0 |
| 5 | 0 | 0 | 0 | 0 | 0 |
| 4 | 0 | 1 | 0 | 0 | 0 |
| 3 | 0 | 1 | 0 | 0 | 0 |
| 2 | 0 | 0 | 0 | 0 | 0 |
| 1 | 0 | 0 | 0 | 0 | 0 |
| 0 | 0 | 0 | 0 | 0 | 0 |

FIG. 26D

| Y ADDRESS | X ADDRESS 0 | 1 | 2 | 3 | 4 |
|---|---|---|---|---|---|
| 9 | B | B | B | R | B |
| 8 | B | B | R | B | B |
| 7 | B | B | R | B | B |
| 6 | B | B | R | B | B |
| 5 | B | B | R | B | B |
| 4 | B | R | B | B | B |
| 3 | B | R | B | B | B |
| 2 | B | R | B | B | B |
| 1 | B | R | B | B | B |
| 0 | B | B | B | B | B |

GRAPHIC DISPLAY CONTROL METHOD AND APPARATUS

This application is a continuation of application Ser. No. 06/621,564, filed June 18, 1984, now abandoned.

BACKGROUND OF THE INVENTION

The present invention relates to a graphic display control method and apparatus which use an interlace type cathode ray tube (CRT).

In a conventional raster scan type graphic display, when a diagonal line is to be displayed, it is displayed stepwise because light points are only provided at picture cells on raster lines. Accordingly, a smoothly continuous diagonal line could not be displayed.

In order to resolve the above problem, it has been proposed to construct each point by a plurality of picture cells capable of being imparted with different luminances, and change the luminances in accordance with fractions derived by calculating coordinates of points on the diagonal line so that the diagonal line is displayed as a smooth line by the change of the luminances of the picture cells. FIGS. 18 and 19 show examples of the diagonal lines displayed by the luminance modulation type graphic display. In FIGS. 18 and 19, black block areas represent the luminances of the respective picture cells.

However, in this luminance modulation type graphic display, the line width is large and not uniform because each of the points forming the line consists of a plurality of picture cells.

SUMMARY OF THE INVENTION

It is an object of the present invention to provide a graphic display control method and apparatus which can display a smooth and non-stepwise line on a CRT.

It is another object of the present invention to provide a graphic display control method and apparatus which can prevent flickering which is likely to occur in an interlace type CRT.

It is another object of the present invention to provide a graphic display control method and apparatus which can display a smooth line of different color from a a background color on an interlace type CRT.

In accordance with the present invention, each picture cell on a CRT screen can be illuminated in a first field and a second field, the illumination of each picture cell in the first field and the second field is controlled in accordance with an operational result of coordinates of each of the points forming the line on the CRT screen, and the illumination position of the picture cell is shifted in an x-direction to eliminate the stepwise display of the line.

Characteristic features of the present invention reside in that a raster scan type CRT is interlace-swept, the illumination of each picture cell on the CRT screen in the first field and the second field is controlled, one picture cell on the CRT screen is illuminated in the first field and the second field to display one point on the screen or one picture cell is illuminated in the first field or the second field and another picture cell which is vertically adjacent to the one picture cell is illuminated in the second field or the first field to display one point on the screen (in other words, one point is displayed on the CRT screen by a combination of illuminations of two vertically adjacent picture cells in the first and second fields), the illumination point on the CRT screen is horizontally shifted, and the line is displayed by a series of points.

BRIEF DESCRIPTION OF THE DRAWINGS

FIG. 1 shows coordinates of a line displayed on a CRT.

FIG. 3 shows the relation between the X, Y addresses and illumination control data in writing the data into a frame memory of the graphic display control apparatus.

FIG. 4 illustrates the first field and the second field on an interlace type CRT screen.

FIG. 8B shows operational results of points on the line shown in FIG. 8A and the relation between the X, Y addresses and illumination control data.

FIG. 12 shows operational results when the line shown in FIG. 6A is to be displayed in the embodiment and the relation between the X, Y addresses and the illumination control data.

FIG. 15 shows operational results when the line shown in FIG. 8A is to be displayed in the second embodiment and the relation between the X, Y addresses and the illumination control data.

FIG. 22 shows the relation between the X, Y addresses, and illumination control data and color control data data when the data are to be written into a frame memory.

FIG. 24B shows operational results of points on the line shown in FIG. 24A and the relation between the X, Y addresses, and the illumination control data and the color data.

FIGS. 26C and 26D show the illumination control data and the color data stored in the frame memory.

DESCRIPTION OF THE PREFERRED EMBODIMENTS

FIG. 1 shows a line (L) to be displayed on an interlace type CRT. The start point coordinate of the line (L) is ($x_0$, $y_0$), the end point coordinate is ($x_0+\Delta x$, $y_0+\Delta y$) and the gradient is ($\Delta y/\Delta x$).

Figure 2:
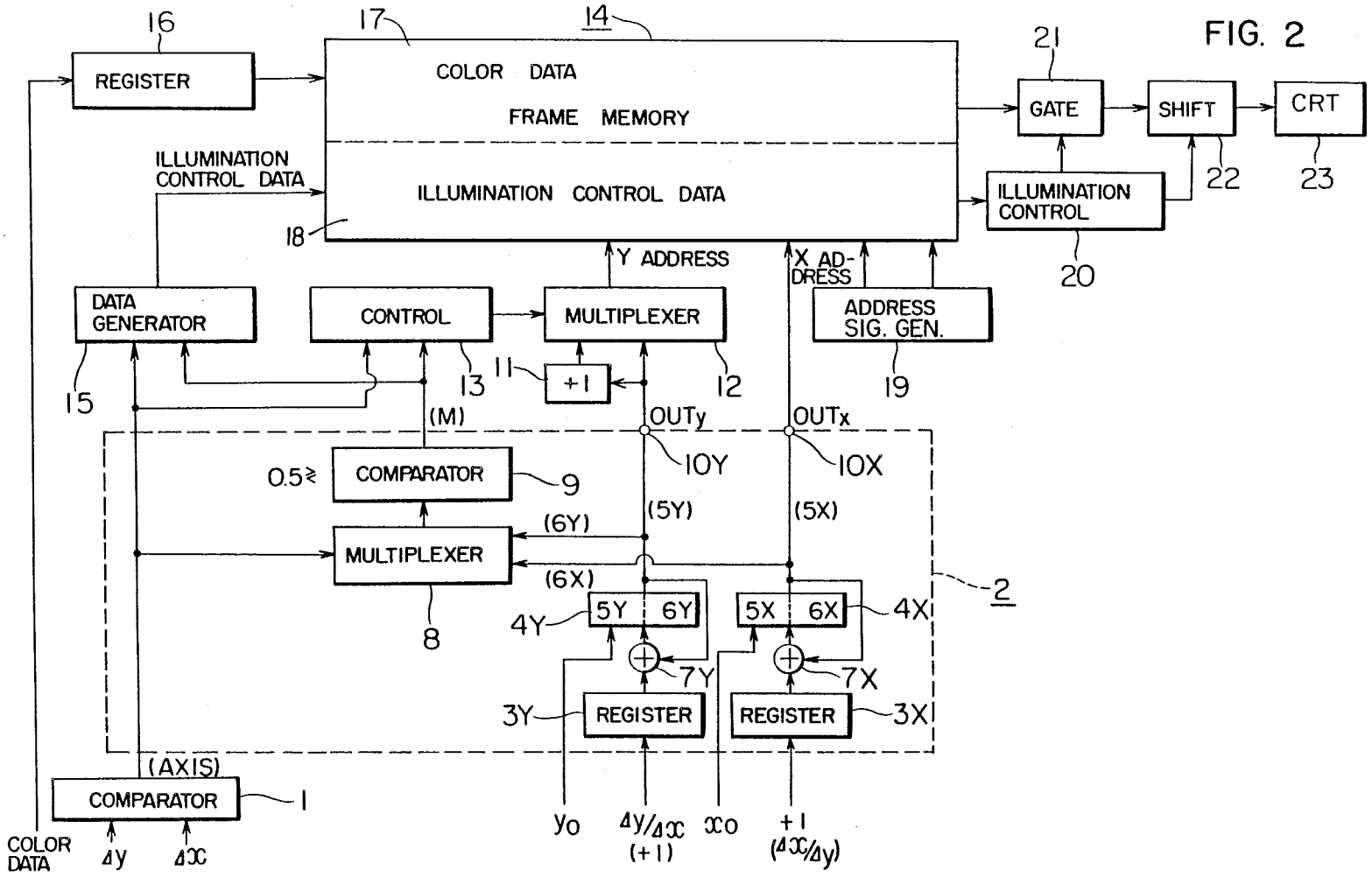
FIG. 2 is a block diagram of one embodiment of a graphic display control apparatus of the present invention.

The start point coordinate ($x_0$, $y_0$), the x component ($\Delta x$), the y component ($\Delta y$), the gradient ($\Delta y/\Delta x$) or ($\Delta x/\Delta y$) and the color data of the line (L) are supplied from a processor. In FIG. 2, numeral 1 denotes a comparator which compares the x component and the y component of the line (L) and produces "0" if $\Delta y \leqq \Delta x$ and "1" if $\Delta y > \Delta x$. When the output (AXIS) of the comparator 1 is "0", it means that the X-axis is the main axis when a DDA (digital differential analyizer) is operated, and when the output AXIS is "1", it means that the Y-axis is the main axis. Numeral 2 denotes the DDA, which sequentially calculates coordinates ($x_1$, $y_1$), ($x_2$, $y_2$), . . . ($x_n$, $y_n$) of points forming the line (L) based on the start point coordinate ($x_0$, $y_0$), the x component ($\Delta x$), the y component ($\Delta y$) and the gradient ($\Delta y/\Delta x$) or ($\Delta x/\Delta y$) supplied from the processor.

The construction of the DDA 2 will now be explained in detail. In FIG. 2, numerals 3X and 3Y denote an X increment register and a Y increment register. When (AXIS) is "0", "1" is retained in the X increment register 3X and ($\Delta y/\Delta x$) is retained in the Y increment register 3Y. When (AXIS) is "1", ($\Delta x/\Delta y$) is retained in the X increment register 3X and "1" is retained in the Y increment register 3Y. For the line (L) shown in FIG. 1, $\Delta y < \Delta x$ and hence (AXIS) is "0". Accordingly, "1" is retained in the X increment register 3X and ($\Delta y/\Delta x$) is retained in the Y increment register 3Y. Numerals 4X and 4Y denote an X coordinate register and a Y coordinate register, which comprise integer registers 5X and 5Y and fraction registers 6X and 6Y, respectively. Numerals 7X and 7Y denote adders which add the contents of the X coordinate register 4X and the Y coordinate register 4Y to the increments retained in the X increment register 3X and the Y increment register 3Y, respectively. The sums are supplied to the X coordinate register 4X and the Y coordinate register 4Y, which retain them in place of the previous contents.

In determining the coordinate ($x_1$, $y_1$) of the line (L) in FIG. 1, the X coordinate ($x_0$) of the start point coordinate ($x_0$, $y_0$) is retained in the X coordinate register 4X, and the Y coordinate ($y_0$) is retained in the Y coordinate register 4Y. The X coordinate ($x_0$) in the X coordinate register 4X and "1" retained in the X increment register 3X are summed in the adder 7X and the sum ($x_0+1$) is retained in the X coordinate register 4X in place of ($x_0$). Similarly, the Y coordinate ($y_0$) retained in the Y coordinate register 4Y and ($\Delta y/\Delta x$) retained in the Y increment register 3Y are summed by the adder 7Y and the sum ($y_0+\Delta y/\Delta x$) is retained in the Y coordinate register 4Y in place of ($y_0$).

Numeral 8 denotes a multiplexer to which the fractions retained in the fraction registers 6X and 6Y of the X coordinate register 4X and the Y coordinate register 4Y are applied. One of them is selected depending on the output (AXIS) of the comparator 1 and it is supplied to a comparator 9. When the (AXIS) is "0", the fraction retained in the fraction register 6Y of the Y coordinate register 4Y is selected and supplied to the comparator 9. When the (AXIS) is "1", the fraction retained in the fraction register 6X of the X coordinate register 4X is selected and supplied to the comparator 9. For the line (L) shown in FIG. 1, the (AXIS) is "0" and the fraction retained in the fraction register 6Y of the Y coordinate register 4Y is selected and supplied to the comparator 9. The comparator 9 determines whether the input fraction is no smaller than 0.5 or smaller than 0.5. If it is no smaller than 0.5, an output (M) of the comparator 9 is "1", and if it is smaller than 0.5, M is "0".

Numerals 10X and 10Y denote output terminals which supply the numbers retained in the integer registers 5X and 5Y of the X and Y coordinate registers 4X and 4Y, respectively. Numeral 11 denotes an adder which adds "1" to an output ($OUT_Y$) at the output terminal 10Y, and numeral 12 denotes a multiplexer which selects the output of the adder 11 or passes the output ($OUT_Y$) of the output terminal 10Y. Numeral 13 denotes a control circuit which controls the multiplexer 12 depending on the output (AXIS) of the comparator 1 and the output (M) of the comparator 9. The multiplexer 12 is controlled by the combination of (AXIS) and (M) in the following manner.

(1) When M="0" and AXIS="0":

The output ($OUT_Y$) of the output terminal 10 is selected and outputted as it is.

(2) When M="1" and AXIS="0":

The output ($OUT_Y$) of the output terminal 10Y is selected and it is outputted as it is, and then the output of the adder 11 is selected to output a sum of ($OUT_Y$) and "1".

(3) When M="0" and AXIS is "1":

The output ($OUT_Y$) of the output terminal 10 is selected and it is outputted as it is.

(4) When M="1" and AXIS is "1":

The output ($OUT_Y$) of the output terminal 10Y is selected and it is outputted as it is.

The output of the multiplexer 12 is used as a Y address signal of a frame memory 14 and the output ($OUT_X$) of the output terminal 10X is used as an X address signal of the frame memory 14.

Numeral 15 denotes an illumination control data generator which produces the illumination control data "0", "1", "2" or "3" based on the output (AXIS) of the comparator 1 and the output M of the comparator 9. When M="0" and (AXIS) is "0", the illumination control data "0" is produced, and when M="1" and (AX- IS)="0", the illumination control data "1" is first produced and then "2" is produced. When M="0" and (AXIS)="1", the illumination control data "0" is produced, and when M="1" and (AXIS)="1", the illumination control data "3" is produced.

Numeral 16 denotes register for retaining a color data supplied from the processor.

The DDA 2 determines the coordinates $(x_1, y_1)$, $(x_2, y_2) \ldots (x_l, y_l) \ldots (x_n, y_n)$ of the points forming the line (L) and generate corresponding X and Y address signals, and stores the color data and the illumination control data at the addresses of a first memory 17 and a second memory 18 of the frame memory 14 designated by the X and Y address signals.

FIG. 3 shows the relation between the X and Y address signals generated when $X_l$ and $Y_l$ are produced at the output terminals $OUT_X$ and $OUT_Y$ of the DDA 2, and M and (AXIS).

When $X_l$ and $Y_l$ are produced at the output terminals $OUT_X$ and $OUT_Y$ of the DDA 2 and when M="0" and "AXIS" is "0", the X address signal is $X_l$, the Y address signal is $Y_l$ and the illumination control data is "0". As a result, the color data is stored at the address of the first memory 17 of the frame memory 14 designated by $X_l$ and $Y_l$, and the illumination control data "0" is stored at the address of the second memory 18 of the frame memory 14 designated by $X_l$ and $Y_l$.

The operation when the outputs of the DDA 2 are $X_l$ and $Y_l$, and M="1" and (AXIS)="0" will now be explained. The address signals $X_l$ and $Y_l$, and the color data and the illumination control data "1" are produced, and the color data is stored at the address of the first memory 17 designated by $X_l$ and $Y_l$ and the illumination control data "1" is stored at the address of the second memory 18 designated by $X_l$ and $Y_l$. Then, the address signals $X_l$ and $(Y_l+1)$, and the color data and the illumination control data "2" are produced, and the color data is stored at the address of the first memory 17 designated by $X_l$ and $(y_l+1)$ and the illumination control data "2" is stored at the address of the second memory 18 designated by $X_l$ and $(y_l+1)$.

When M="0" and (AXIS)="1", the address signals $X_l$ and $Y_l$, and the color data and the intensity control data "0" are produced, and the color data is stored at the address of the first memory 17 designated by $X_l$ and $Y_l$ and the illumination control data "0" is stored at the address of the second memory 18 designated by $X_l$ and $Y_l$.

When M="1" and (AXIS)="1", the address signals $X_l$ and $Y_l$, and the color data and the illumination control data "3" are produced, and the color data is stored at the address of the first memory 17 designated by $X_l$ and $Y_l$ and the illumination control data "3" is stored at the address of the second memory 18 designated by $X_l$ and $Y_l$.

In this manner, the addresses of the frame memory 14 are determined for the respective points forming the line (L), and the color data and the intensity control data are stored at those addresses.

A construction for reading out the color data and the illumination control data stored in the frame memory 14 and displaying them on the CRT is explained.

In FIG. 2, numeral 19 denotes an address signal generator which generates an address signal in synchronism with a raster scan of the CRT 23. Numeral 20 denotes an illumination control circuit which controls a gate circuit 21 and a shift circuit 22 based on the illumination control data read from the second memory 18 of the frame memory 14. Numeral 23 denotes the interlace type CRT on which a first field shown by broken lines in FIG. 4 and a second field shown by solid lines are formed. The CRT 23 has a display screen which has a plurality of vertically and horizontally arranged picture cells (pixels). The gate circuit 21 is opened and closed by the illumination control data supplied from the illumination control circuit 20 to gate or block the color data read from the first memory 17 of the frame memory 14 to the shift circuit 22. When the illumination control data of the second memory 18 at the address designated by the address signals $X_l$ and $Y_l$ generated by the address signal generator 19 is "0", the gate circuit 21 is opened at timings of the first field and the second field of the picture cells of the CRT 23 corresponding to the address signals $X_l$ and $Y_l$ to transmit the color data. When the illumination control data is "1", the gate circuit 21 is opened to transmit the color data at the timing of the first field, and the gate circuit 21 is closed to block the color data at the timing of the second field. When the illumination control data is "2", the gate circuit 21 is closed to block the color data at the timing of the first field and the gate circuit 21 is opened to transmit the color data at the timing of the second field. When the illumination control data is "3", the gate circuit 21 is opened to transmit the color data in both the first field and the second field.

The shift circuit 22 shifts the color data in the X direction by ½ pixel position only when the illumination control data is "3". The color data may be shifted by ½ pixel position by delaying a clock to be supplied to a register of the shift circuit 22 through a delay circuit.

Figure 5A:
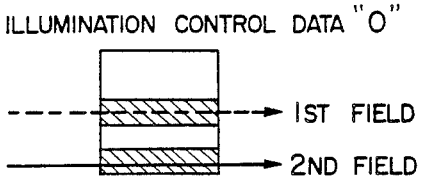
FIGS. 5A–5D show illumination of picture cells in one embodiment of the present invention.
Figure 5B:
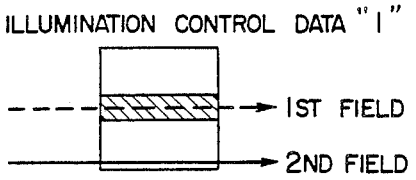
Figure 5C:
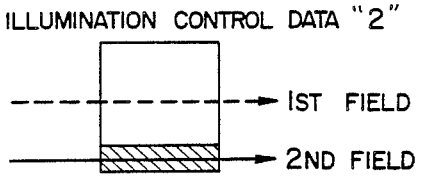
Figure 5D:
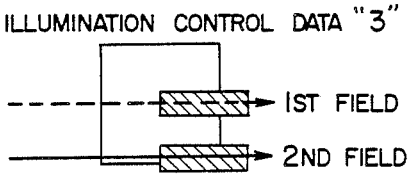

FIGS. 5A–5D illustrate the illumination of one pixel $(X_l, Y_l)$ on the CRT 23. In FIG. 5A, the illumination control data is "0", and the illumination occurs in both the first field and the second field. In FIG. 5B, the illumination control data is "1" and the illumination occurs only in the first field. In FIG. 5C, the illumination control signal is "2" and the illumination occurs only in the second field. In FIG. 5D, the illumination control signal is "3" and the illumination occurs in both the first field and the second field with ½ pixel position shifted by the shift circuit 22.

Figure 6A:
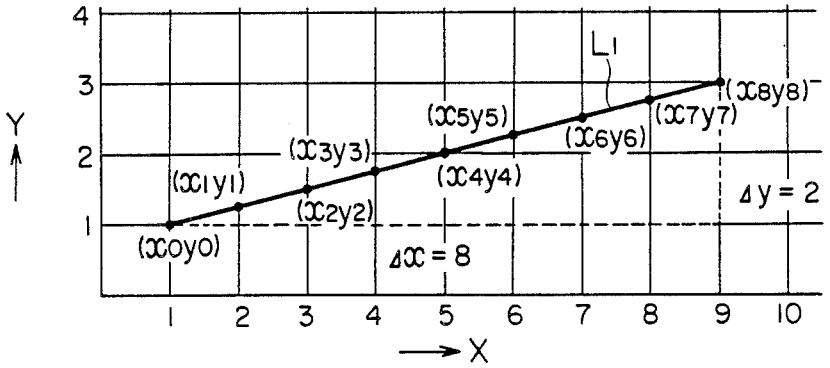
FIG. 6A shows coordinates of a line ($L_1$) displayed in the above embodiment.
Figures 6B, 6C:
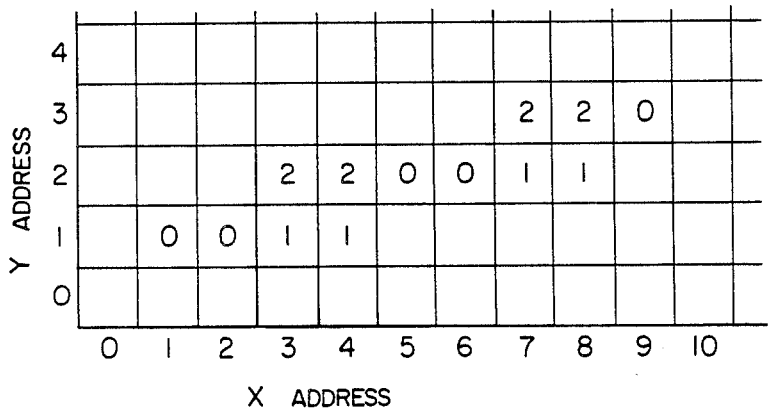
FIG. 6B shows operational results of the points on the line shown in FIG. 6A and the relation between the X, Y addresses and the illumination control data.
FIG. 6C shows the illumination control data stored in the frame memory.

The operation for displaying a line $(L_1)$ shown in FIG. 6A on the CRT 23 will now be explained. The line $(L_1)$ has a start point coordinate $(x_0, y_0)=(1, 1)$, an X component $\Delta x=8$, a Y component $\Delta y=2$, a gradient (2/8) and an end point coordinate $(x_8, y_8)=(9, 3)$. Since $\Delta x\ (=8)>\Delta y\ (=2)$, (AXIS)="0" and "1" is held in the X increment register 3X and "$\Delta y/\Delta x=2/8=0.25$" is held in the Y increment register 3Y. Thus, the X coordinates of the points $(x_1, y_1)$ $(x_2, y_2)$, . . . $(x_8, y_8)$ are obtained by sequentially incrementing the start point coordinate "1" by one, and the Y coordinates are obtained by sequentially adding "0.25" to the start point coordinate "1". (See FIG. 6B) The $(OUT_X)$ and the $(OUT_Y)$ of each point are integer portions of the X and Y coordinates as shown in FIG. 6B. The fraction portion of the Y coordinate at each point is compared with "0.5" by the comparator 9, and if it is no smaller than 0.5, the output M="1" is produced, and if it is smaller than 0.5, the output M="0" is produced. In FIG. 6B, the fraction portions of the Y coordinates of the points $(x_0, y_0)$, $(x_1, y_1)$, $(x_4, y_4)$, $(x_5, y_5)$ and $(x_8, y_8)$ are smaller than "0.5" and the output M="0" is produced for those points. On the other hand, the fraction portions of the Y coordinates of the points $(x_2, y_2)$, $(x_3, y_3)$, $(x_6, y_6)$ and $(x_7, y_7)$ are larger than "0.5" and the output M=1 is produced for those points. The X addresses supplied to the frame memory 14 are 1, 2, 3, 4, 5, 6, 7, 8 and 9 as shown in FIG. 6B while the Y addresses are determined by the combination of M and AXIS). For example, the Y address at the point ($x_0$, $y_0$) is "1" because M="0" and (AXIS)="0" (see FIG. 3), the Y address at the point ($x_1$, $y_1$) is "1" because M="0" and (AXIS)="0", and the Y address at the point ($x_2$, $y_2$) is first "1" and then "2" because M="1" and (AXIS)="0" (see FIG. 3). The illumination control data at the respective points are also determined by the combination of M and (AXIS). For example, at the point ($x_0$, $y_0$), M="0" and (AXIS)="0" and the illumination control data is "0" (see FIG. 3), and at the point ($x_2$, $Y_2$), M="1" and (AXIS)="0" and the intensity control data is first "1" and then "2". FIG. 6C shows the illumination control data stored in the second memory 18 of the frame memory 14.

Figure 7A:
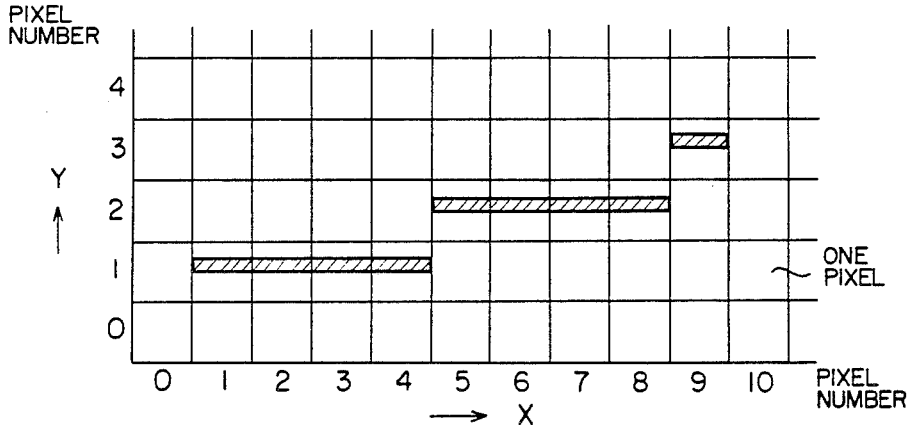
FIGS. 7A to 7C show a first field and a second field of the CRT screen and the illumination of the picture cells in the first and second fields.
Figure 7B:
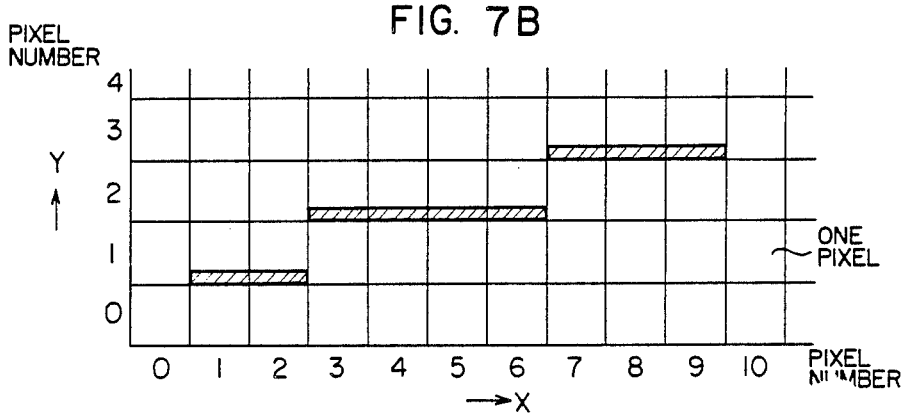
Figure 7C:
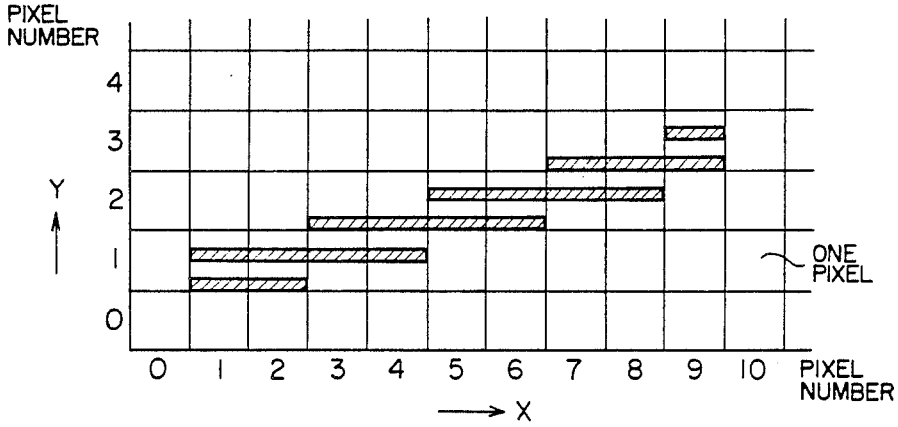

FIG. 7A shows the illumination status of the pixels on the screen of the CRT 23 in the first field. The illumination control data shown in FIG. 6C are sequentially read out in synchronism with the raster scan and the color data is controlled by the gate circuit 21 in accordance with the illumination control data so that the illumination status shown in FIG. 7A is attained in the first field. FIG. 7B shows an illumination status in the second field, and FIG. 7C shows the illumination status in the first and second fields (FIG. 7C is a superposition of FIG. 7A and FIG. 7B.)

An operation to display a line ($L_2$) shown in FIG. 8A on the CRT 23 will now be explained. The line ($L_2$) has a start point coordinate ($x_0$, $y_0$) =(1, 1), an X component $\Delta x=2$, a Y component $\Delta Y=8$ and a gradient $\Delta x/\Delta y=2/8$ =0.25. Since $\Delta y>\Delta x$, (AXIS)="1". Thus, as shown in FIG. 8B, the Y addresses are obtained by sequentially adding "1" to the start point coordinate "1" while the X addresses and the illumination control data are determined by the combination of M and (AXIS). FIG. 8C shows the illumination control data stored in the second memory 18 of the frame memory 14. FIG. 9 shows the illumination status in the first field and the second field obtained when the illumination control data stored in the frame memory 14 as shown in FIG. 8C are sequentially read out and the gate circuit 21 and the shift circuit 22 are controlled in accordance with the illumination control data.

Figure 10:
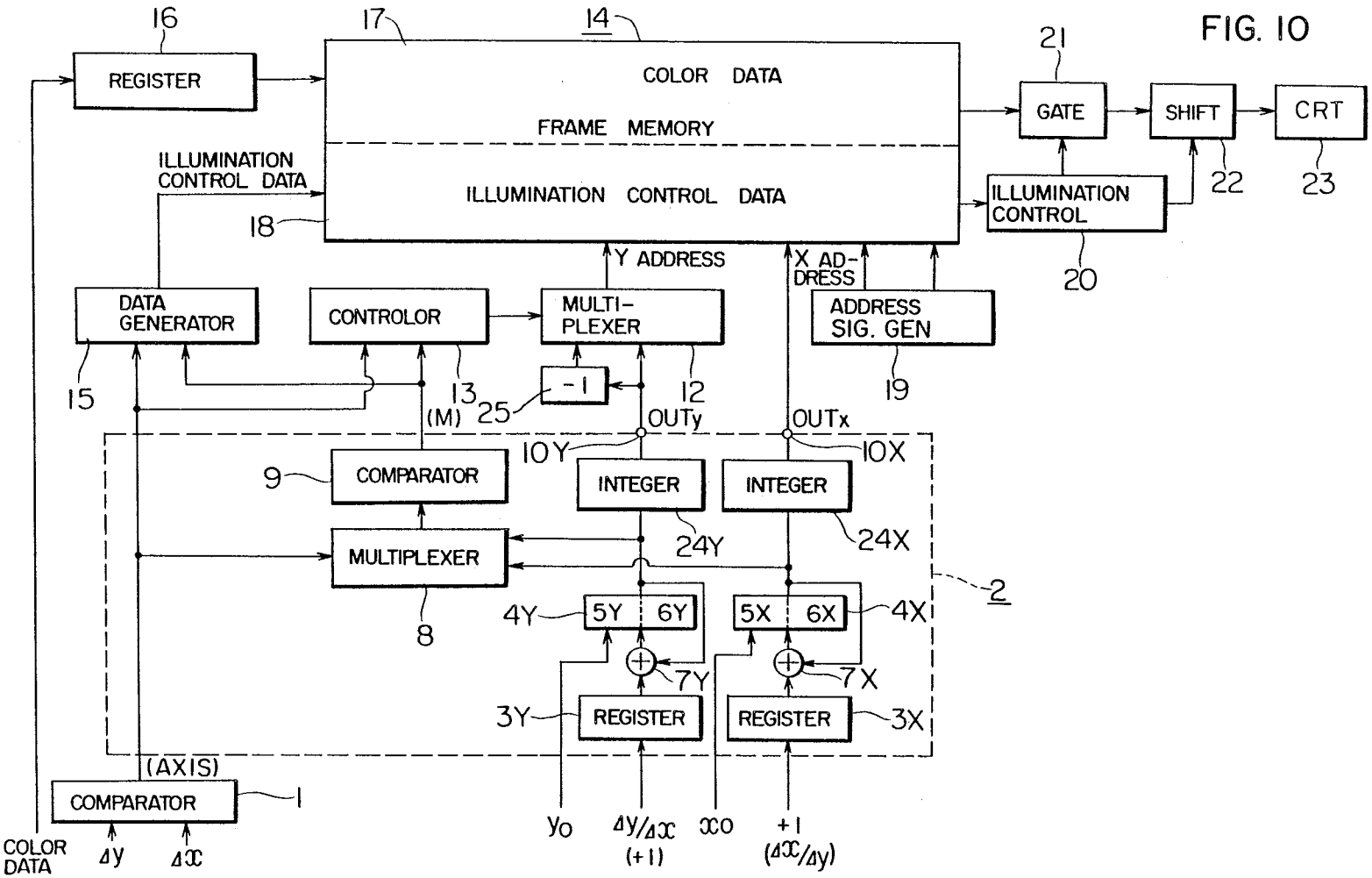
FIG. 10 is a block diagram of a second embodiment of the present invention.

A second embodiment of the present invention will now be explained. FIG. 10 shows the circuit configuration of the second embodiment. Numerals 24X and 24Y denote integer circuits which count as one the fractions of more than 0.5 and cut away the rest for the number supplied from the X coordinate register 4X and the Y coordinate register 4Y, respectively, and numeral 25 denotes a subtractor which subtracts "1" from the output ($OUT_Y$) of the output terminal 10Y.

Figures 11, 13:
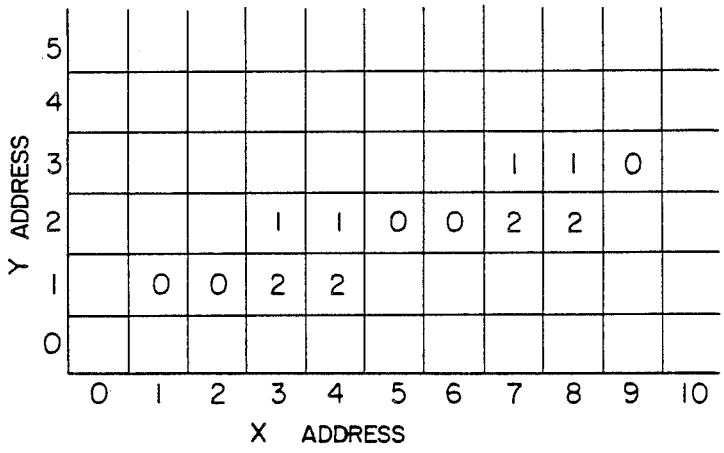
FIG. 11 shows a relation between X, Y addresses and illumination control data in writing the data into a frame memory of the embodiment.
FIG. 13 shows the illumination control data stored in the frame memory of the embodiment.
Figure 14A:
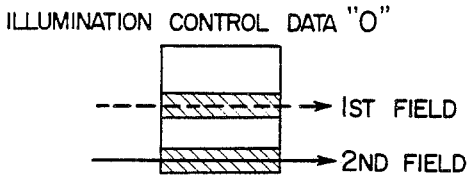
FIGS. 14A–14D show illumination of the picture cells in the second embodiment.
Figure 14B:
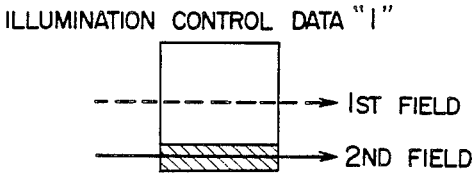
Figure 14C:
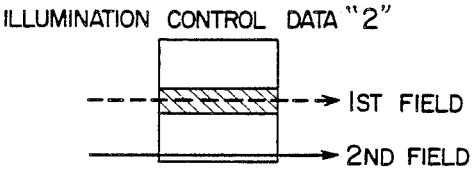
Figure 14D:
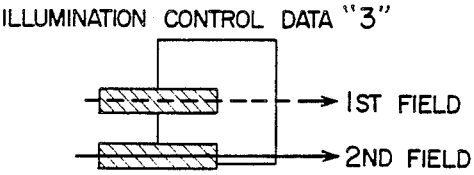

FIG. 11 shows M (AXIS), X address, Y address and illumination control data when ($OUT_X$) is $X_l$ and ($OUT_Y$) is $Y_l$. When M="0" and (AXIS)="0", and when M ="0" and (AXIS)="1", the illumination control data "0" is stored at the address of the second memory 18 of the frame memory 14 designated by $X_l$ and $Y_l$. When M="1" and (AXIS)="0", the illumination control data "1" is first stored at the address of the second memory 18 designated by $X_l$ and $Y_l$, and then the illumination control data "2" is stored at the address designated by $X_l$ and ($Y_l-1$). When M="1" and (AXIS)="1", the illumination control data "3" is stored at the address of the second memory 18 designated by $X_l$ and $Y_l$.

FIG. 12 shows the X and Y coordinates, the rounded X and Y coordinates (the outputs of the integer circuits 24X and 24Y of FIG. 10), the X address, the Y address and the illumination control data when the line ($L_1$) shown in FIG. 6 is to be displayed in the second embodiment, and FIG. 13 shows the illumination control data stored in the second memory 18 of the frame memory 14.

FIGS. 14A–14D illustrate the illumination status of one pixel on the CRT 23 when the illumination control data is read from the second memory 18, and the gate circuit 21 and the shift circuit 22 are controlled by the illumination control circuit 20 in accordance with the second embodiment. The illumination control method shown in FIG. 14A–14D is different from that shown in FIG. 5A–5D. The illumination status of the pixels on the CRT 23 in the second embodiment are similar to those shown in FIGS. 7A–7C.

Figure 8A:
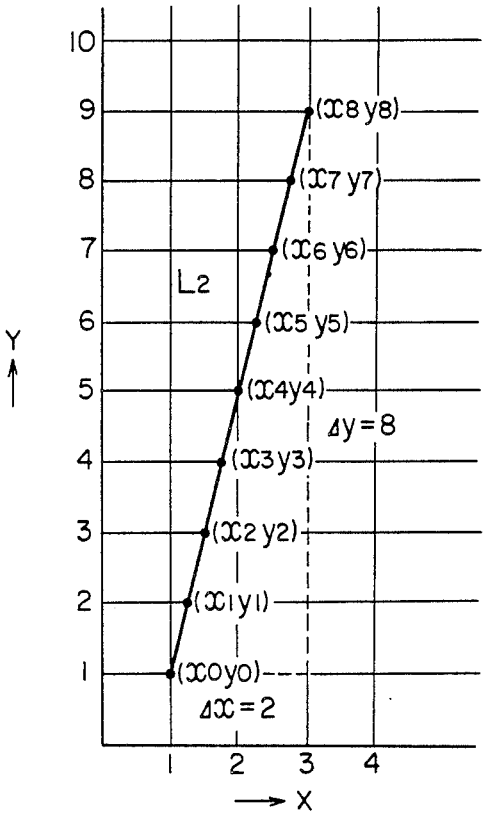
FIG. 8A shows coordinates of a line displayed in the embodiment.
Figure 9:
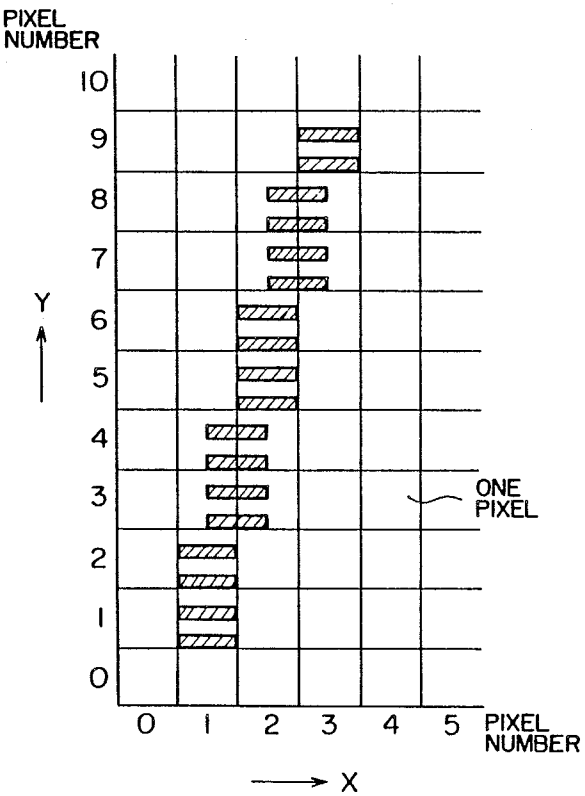
FIG. 9 shows the illumination of the picture cells on the CRT screen in the embodiment.
Figure 8C:
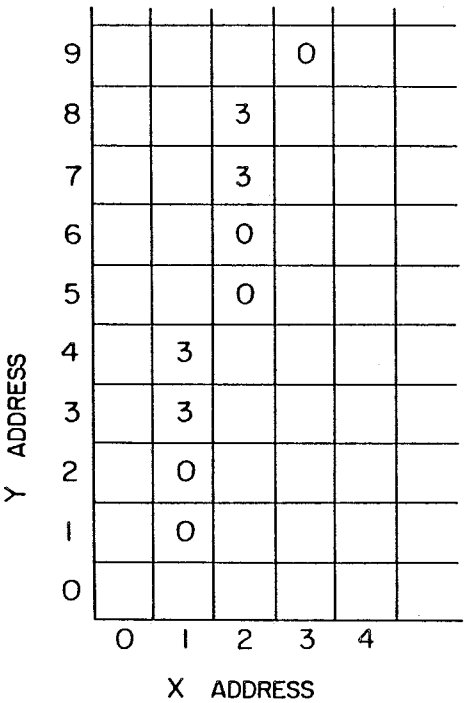
FIG. 8C shows the illumination control data stored in the frame memory.
Figure 16:
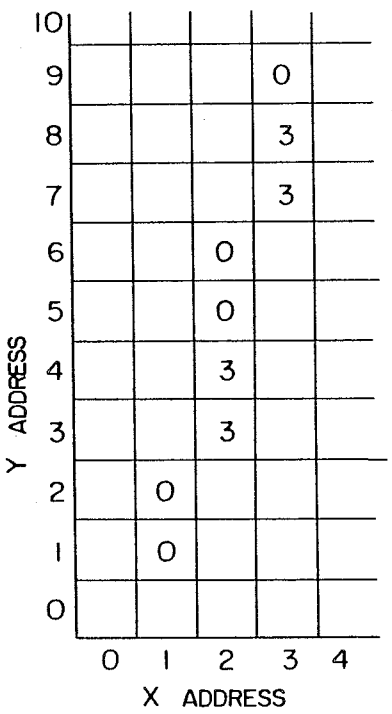
FIG. 16 shows the illumination control data stored in the frame memory of the embodiment.
Figure 17:
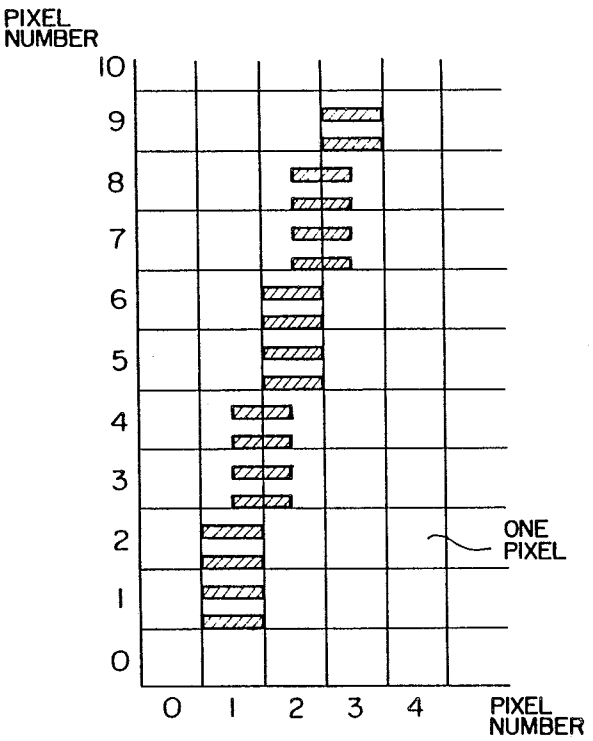
FIG. 17 shows the illumination of the picture cells on the CRT screen in the embodiment.

FIG. 15 shows the X and Y coordinates, the rounded X and Y coordinates, M, (AXIS), the X address, the Y address and the illumination control data when the line ($L_2$) shown in FIG. 8A is to be displayed on the CRT 23 in the second embodiment, FIG. 16 shows the illumination control data stored in the second memory 18 of the frame memory 14, and FIG. 17 shows the illumination status on the CRT 23 obtained when the illumination control data is read from the second memory 18 shown in FIG. 16 and the gate circuit and the shift circuit 22 are controlled by the illumination control circuit 20. The illumination status of the CRT 23 shown in FIG. 17 is identical to that in the first embodiment (FIG. 9).

Figure 18:
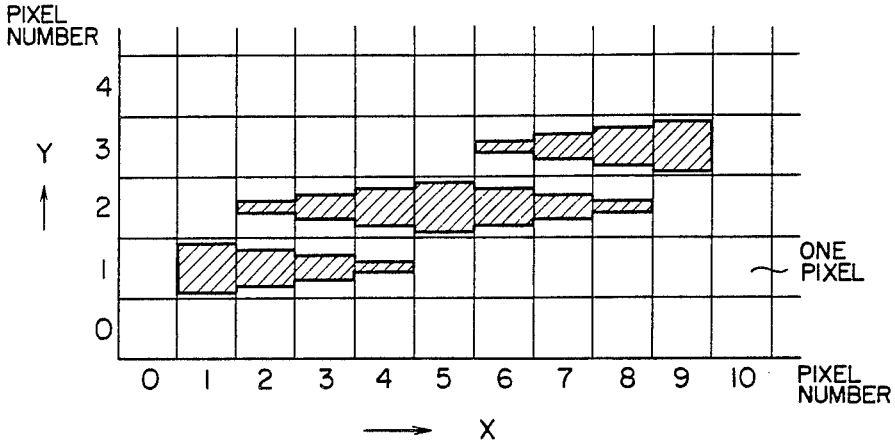
FIG. 18 PRIOR ART
FIGS. 18 and 19 show illumination of the picture cells on the CRT screen in a prior art luminance modulation type graphic display control apparatus.
Figure 19:
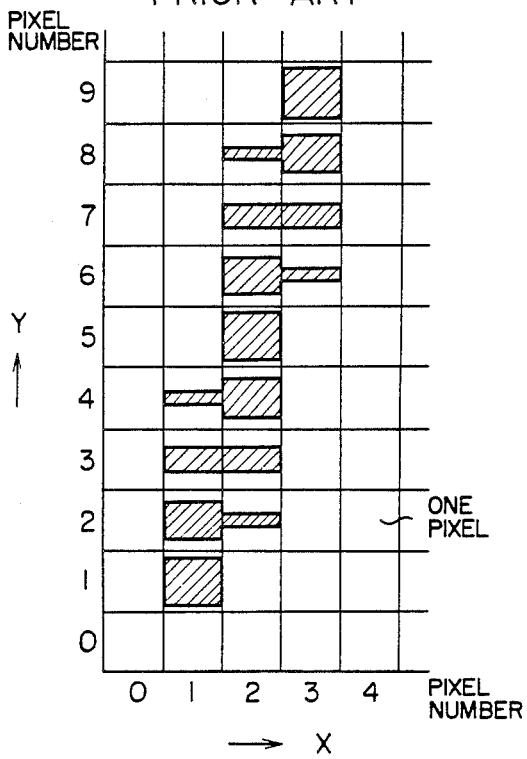
FIG. 19 PRIOR ART

FIGS. 18 and 19 show examples of display on the CRT of the prior art luminance modulation type graphic display apparatus. Black block areas in FIGS. 18 and 19 represent the luminance of each pixel. In FIG. 18, the line ($L_1$) shown in FIG. 6A is displayed on the CRT, and in FIG. 19, the line ($L_2$) shown in FIG. 8A is displayed on the CRT.

In the above embodiment, the illumination of the pixel is controlled in the first field and the second field and the illumination position of the pixel is shifted in the X direction so that the line is displayed smoothly and non-stepwise. In the above embodiment, since one point is illuminated in paired relation with the first field and the second field of the same pixel or the first field and the second field of the adjacent pixels, the flicker which is likely to occur in the interlace type CRT is prevented. The above embodiment can be attained by the same scale of hardware as the prior art luminance modulation type display apparatus.

Figure 20:
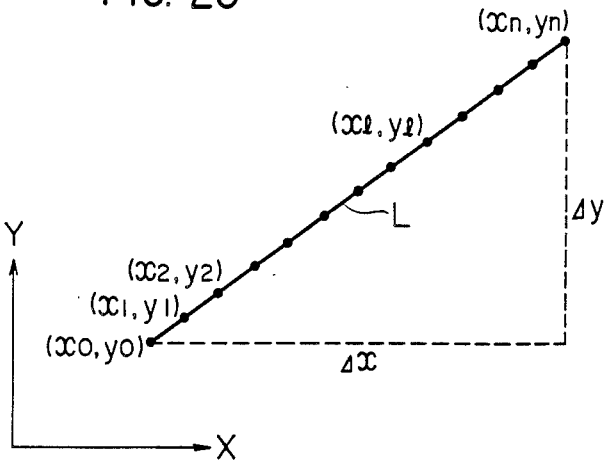
FIG. 20 shows coordinates of a line to be displayed on a CRT.

An embodiment which displays a smooth and non-stepwise color line on a color CRT will now be explained. FIG. 20 shows a line (L) to be displayed on an interlace type color CRT. The line (L) has a start point coordinate ($x_0$, $y_0$), an end point coordinates ($x_0+\Delta x$, $y_0+\Delta y$) and a gradient ($\Delta y/\Delta x$). If $\Delta x$ is negative, the start point coordinate ($x_0$, $y_0$) and the end point coordinate ($x_0+\Delta x$, $y_0+\Delta y$) are exchanged so that $\Delta x$ is always positive for a line having any gradient. Accordingly, $\Delta x$ has 0 or a positive value in the present embodiment.

The start point coordinate ($x_0$, $y_0$), the X component ($\Delta x$), the Y component ($\Delta y$), the gradient ($\Delta y/\Delta x$) or ($\Delta x/\Delta y$) and the color data for the line (L) shown in FIG. 20 are supplied from a processor.

Figure 21:
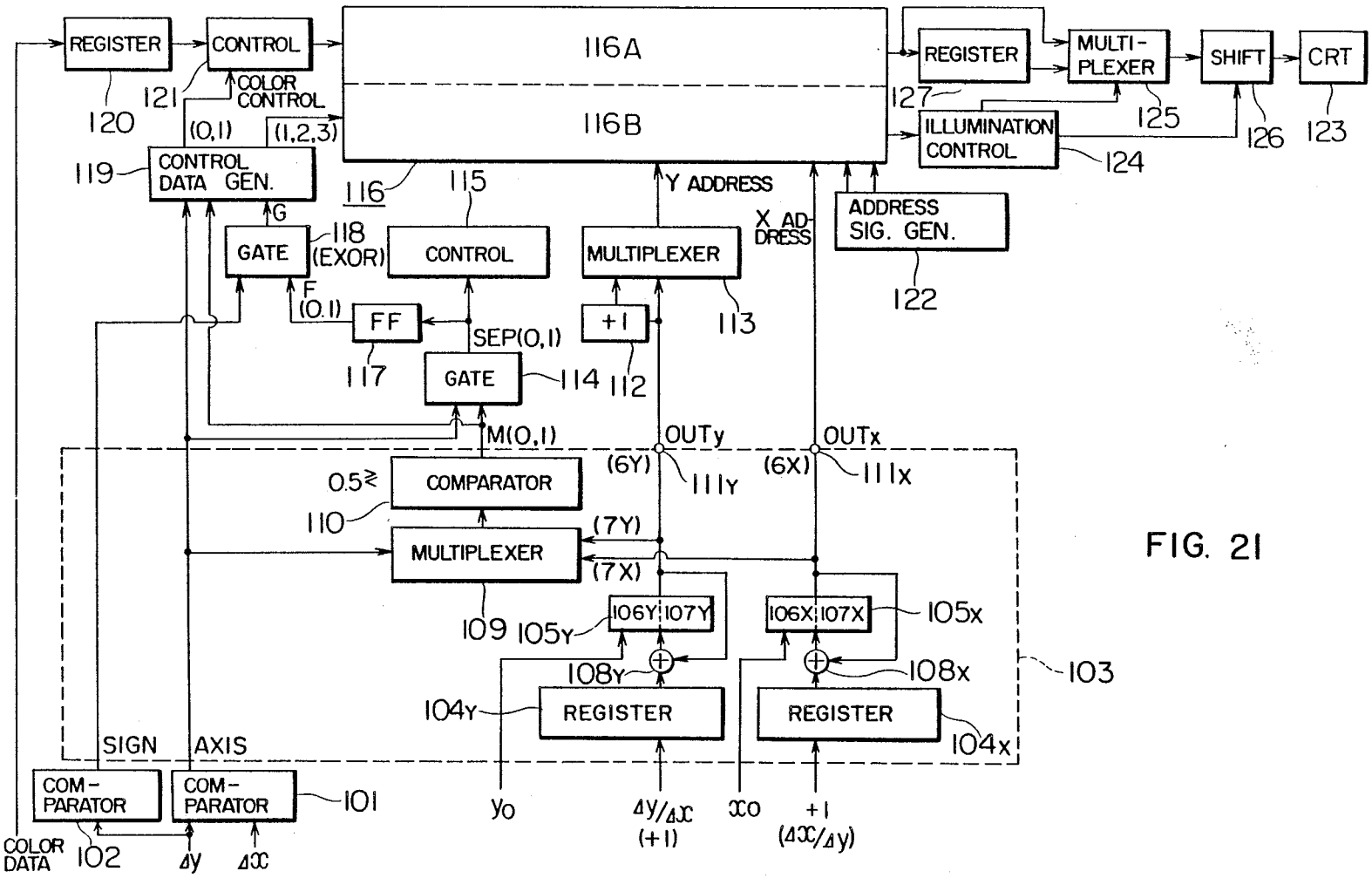
FIG. 21 is a block diagram of another embodiment of the graphic display control apparatus of the present invention.

FIG. 21 shows a graphic display control apparatus in accordance with the present embodiment. Numeral 101 denotes a comparator which compares the X component ($\Delta x$) and the Y component ($\Delta y$) of the line (L), and if $\Delta y \leqq \Delta x$, produces an output "0", and if $\Delta y > \Delta x$, produces an output "1". When the output (AXIS) of the comparator 101 is "0", it means that the X axis is the main axis when a DDA (digital differential analyzer) is operated, and when (AXIS) is "1", it means that the Y axis is the main axis.

Numeral 102 denotes a comparator which produces an output "0" when the input $\Delta y$ is 0 or positive, and produces an output "1" when $\Delta y$ is negative. When the output (SIGN) of the comparator 102 is "0", it means that the Y axis changes in a positive direction when the DDA is operated, and when the (SIGN) is "1", it means that the Y axis changes in a negative direction.

Numerals 103 denotes the DDA which sequentially calculates the coordinates $(x_1, y_1), (x_2, y_2) \ldots (x_n, y_n)$ of the points forming the line (L) based on the start point coordinate $(x_0, y_0)$, the X component ($\Delta x$), the Y component ($\Delta y$) and the gradient ($\Delta y/\Delta x$) or ($\Delta x/\Delta y$) of the line (L) supplied from the processor.

The construction of the DDA 103 will now be explained in detail. In FIG. 21, numerals 104X and 104Y denote an X increment register and a Y increment register. When the (AXIS) is "0", "1" is retained in the X increment register 104X and ($\Delta y/\Delta x$) is retained in the Y increment register 104Y. When the (AXIS) is "1", ($\Delta x/\Delta y$) is retained in the X increment register 104X and "1" is retained in the Y increment register 104Y. For the line (L) shown in FIG. 20, $\Delta y < \Delta x$ and hence the (AXIS) is "0". Accordingly, "1" is retained in the X increment register 104X and ($\Delta y/\Delta x$) is retained in the Y increment register 104Y. Numerals 105X and 105Y denote an X coordinate register and a Y coordinate register, which comprises integer registers 106X and 106Y and fraction registers 107X and 107Y, respectively. Numerals 108X and 108Y denote adders which add the contents of the X coordinate register 105X and the Y coordinate register 105Y to the increments retained in the X increment register 104X and the Y increment register 104Y, respectively. The sums are supplied to the X coordinate register 105X and the Y coordinate register 105Y which retain the sums in place of the previous contents.

When the coordinate $(x_1, y_1)$ of the line (L) of FIG. 20 is to be determined, the X coordinate $(x_0)$ of the start point coordinate $(x_0, y_0)$ is held in the X coordinate register 105X, and the Y coordinate $(y_0)$ is held in the Y coordinate register 105Y. The X coordinate $(x_0)$ held in the X coordinate register 105X and "1" held in the X increment register 104X are summed by the adder 108X, and the sum $(x_0+1)$ is held in the X coordinate register 105X in place of $x_0$. The Y coordinate $(y_0)$ held in the Y coordinate register 105Y and ($\Delta y/\Delta x$) held in the Y increment register 104Y are summed by the adder 108Y and the sum $(y_0+\Delta y/\Delta x)$ is held in the Y coordinate register 105Y in plce of $y_0$.

Numeral 109 denotes a multiplexer to which the fraction portions held in the fraction registers 107X and 107Y of the X coordinate register 105X and the Y coordinate register 105Y are supplied. One of them is selected depending on the output (AXIS) of the comparator 101 and supplied to a comparator 110. When the (AXIS) is "0", the fraction held in the fraction register 107Y of the Y coordinate register 105Y is selected and supplied to the comparator 110. When the (AXIS) is "1", the fraction held in the fraction register 107X of the X coordinate register 105X is selected and supplied to the comparator 110. For the line (L) shown in FIG. 20, the (AXIS) is "0" and hence the fraction held in the fraction register 107Y of the Y coordinate register 105Y is selected and supplied to the comparator 110. The comparator 110 determines whether the input fraction is no smaller than 0.5 or smaller than 0.5. If it is no smaller than 0.5, the output M of the comparator 110 is "1", and if it is smaller than 0.5, the output M is "0".

Numerals 111X and 111Y denote output terminals which produce the numbers held in the integer registers 106X and 106Y of the X and Y coordinate registers 105X and 105Y. Numeral 112 denotes an adder which adds one to the output ($OUT_Y$) of the output terminal 111Y, and numeral 113 denote a multiplexer. The output of the adder 112 is selected or the output ($OUT_Y$) of the output terminal 111Y is passed by the multiplexer 113.

Numeral 114 denotes a gate circuit which produces an output (SEP) based on the (AXIS) and M. When the (AXIS) is "0" and M is "1", the output (SEP) is "1", and the output (SEP) is "0" in all other cases.

Numeral 115 denotes a control circuit which controls the multiplexer 113 in accordance with the output (SEP) of the gate circuit 114, in the following manner.

(1) when SEP="0":

The output ($OUT_Y$) at the output terminal 111Y is selected and it is outputted as it is.

(2) when (SEP)="1":

The output ($OUT_Y$) at the output terminal 111Y is first selected and outputted as it is, and then the output of the adder 112 is selected to produce a sum of the ($OUT_Y$) and "1".

The output of the multiplexer 113 is used as a Y address signal for the frame memory 116, and the output ($OUT_X$) of the output terminal 111X is used as an X address signal for the frame memory 116.

Numeral 117 denotes a flip-flop which is reset and produces an output (F) "0" when the output (SEP) of the gate circuit 114 is "0", and when the output (SEP) is "1", the flip-flop 117 is flipped at the end of a sequence of processing in the DDA 103. Thus, the output F of the flip-flop 117 alternately changes between "0" and "1" for each end of the series of processing by the DDA 103.

Numeral 118 denotes a gate circuit which exclusively OR's the output F of the flip-flop 117 and the output (SIGN) of the comparator 102 to produce an output G. When F="0" and (SIGN)="0", G="0", when F="0" and (SIGN)=1, G="1", when F="1" and (SIGN)="0", G="1", and when F="1" and (SIGN)=1, G="0".

Numeral 119 denotes a control data generator which produces the illumination control data "0", "1", "2" or "3" and the color control data "0" or "1" based on the output (AXIS) of the comparator 101, the output M of the comparator 110 and the output G of the gate circuit 118. The control data generator 119 operates in the following manner.

(1) When AXIS="0" and M="0":

The illumination control data is "0" and the color control data is "1".

(2) When AXIS="0", M="1" and G="0":

The illumination control data is "3" and the color control data is "0", and then the illumination control data is "3" and the color control data is "1".

(3) When AXIS="0", M="1" and G="1":

The illumination control data is "2" and the color control data is "1", and then the illumination control data is "2" and the color control data is "0".

(4) When AXIS="1" and M="0":

The illumination control data is "0" and the color control data is "1".

(5) When AXIS="1" and M="1":

The illumination control data is "1" and the color control data is "1".

Numeral 120 denotes a register which retains the color data supplied from the processor. Numeral 121 denotes a control circuit which permits or inhibits the writing of the color data into the frame memory 116 by the color control data supplied from the control data generator 119. When the color control data is "1", it permits the writing, and when the color control data is "0", it inhibits the writing.

The DDA 103 calculates the coordinates $(x_1, y_1)$, $(x_2, y_2)$, . . . $(x_l, y_l)$, . . . $(x_n, y_n)$ of the points forming the line (L), generates the X and Y address signals corresponding to the coordinates and stores the color data and the illumination control data at the addresses of the first memory 116A and the second memory 116B of the frame memory 116 designated by the X and Y addresses.

FIG. 22 shows the X and Y address signals, the illumination control data, the color control data and the outputs M, AXIS and G, which are generated when $X_l$ and $Y_l$ are produced at the output terminals $OUT_X$ and $OUT_Y$ of the DDA 103.

When $X_l$ and $Y_l$ are produced at the output terminals $OUT_X$ and $OUT_Y$ of the DDA 103, M="0", (AXIS)="0", the X address signal is $X_l$, the Y address signal is $Y_l$, the illumination control data is "0" and the color control data is "1". As a result, the color data (identified as "C.D." in FIG. 22) is stored at the address of the first memory 116A of the frame memory 116 designated by $X_l$ and $Y_l$, and the illumination control data "0" is stored at the address of the second memory 116B of the frame memory 116 designated by $X_l$ and $Y_l$.

The operation when the outputs of the DDA 103 are $X_l$ and $Y_l$, M="1" and (AXIS) is "0" will now be explained. The operation differs depending on the status of the flip-flop 117. When G="0", the address signals $X_l$ and $Y_l$, the illumination control data "3" and the color control data "0" are produced, and the illumination control data "3" is stored at the address of the second memory 116B designated by $X_l$ and $Y_l$. (The writing of the color data into the first memory 116A is inhibited.)

Next, the address signals $X_l$ and $(Y_l+1)$, the illumination control data "3" and the color control data "1" are produced, and the color data is stored at the address of the first memory 116A designated by $X_l$ and $(Y_l+1)$, and the illumination control data "3" is stored at the address of the second memory 116B designated by $X_l$ and $(Y_l+1)$. When G="1", the address signals $X_l$ and $Y_l$, the illumination control data "2" and the color control data "1" are first produced, and the color data is stored at the address of the first memory 116A designated by $X_l$ and $Y_l$, and the illumination control data "2" is stored at the address of the second memory 116B designated by $X_l$ and $Y_l$. Then, the address signals $X_l$ and $(Y_l+1)$, the illumination control data "2" and the color control data "0" are produced, and the illumination control data "2" is stored at the address of the second memory 116B designated by $X_l$ and $(Y_l+1)$. (The writing of the color data into the first memory 116A is inhibited.)

When M="0" and (AXIS)="1", the address signals $X_l$ and $Y_l$, the color data, the illumination control data "0" and the color control data "1" are produced, and the color data is stored at the address of the first memory 116A designated by $X_l$ and $Y_l$, and the illumination control data "0" is stored at the address of the second memory 116B designated by $X_l$ and $Y_l$.

When M="1" and (AXIS)="1", the address signals $X_l$ and $Y_l$, the color data, the illumination control data "1" and the color control data "1" are produced, and the color data is stored at the address of the first memory 116A designated by $X_l$ and $Y_l$, and the illumination control data "1" is stored at the address of the second memory designated by $X_l$ and $Y_l$.

In this manner, the addresses of the frame memory 116 are determined for the respective points forming the line (L), and the color data and the illumination control data are stored at those addresses.

A construction for reading out the color data and the illumination control data stored in the frame memory 116 and displaying them on the CRT will now be explained.

In FIG. 21, numeral 122 denotes an address signal generator which generates an address signal in synchronism with the raster scan of a CRT 123. Numeral 124 denotes an illumination control circuit which controls a multiplexer 125 and a shift circuit 126 based on the illumination control data read from the second memory 116B of the frame memory 116. Numeral 123 denotes the interlace type CRT which forms one image by a first field shown by broken lines in FIG. 4 and a second field shown by solid lines. Numeral 127 denotes a register which holds a color data for each pixel read from the first memory 116A of the frame memory 116 and provides a color data which is one pixel previous to the color data read from the first memory 116A, to the multiplexer 125.

The multiplexer 125 is operated by the illumination control data supplied from the illumination control circuit 124 to select the color data read from the first memory 116A of the frame memory 116 or the one-pixel previous color data held in the register 127 and supply it to the shift circuit 126. When the illumination control data read from the second memory at the address designated by the address signals $X_l$ and $Y_l$ generated by the address signal generator 123 is "0", the current color data read from the first memory 116A is selected at timings of the first field and the second field of the CRT 123 corresponding to the address signals $X_l$ and $Y_l$. When the illumination control signal is "1", the current color data read from the first memory 116A is selected in both the first field and the second field. When the illumination control data is "2", the current color data read from the first memory 116A is selected at the timing of the first field, and the one-pixel previous color data held in the register 127 is selected at the timing of the second field. When the illumination control data is "3", the one-pixel previous color data is selected at the timing of the first field and the current color data is selected at the timing of the second field.

The shift circuit 126 shifts the color data by ½ pixel position in the X direction only when the illumination control data is "1". The color data may be shifted by ½ pixel position by delaying a clock supplied to a register in the shift circuit 126, by a delay circuit.

Figure 23A:
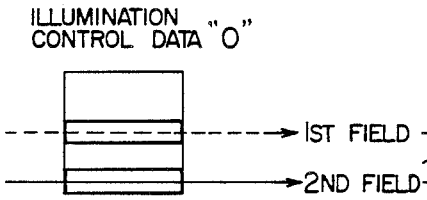
FIGS. 23A–23D show illumination of the picture cells in the embodiment.
Figure 23C:
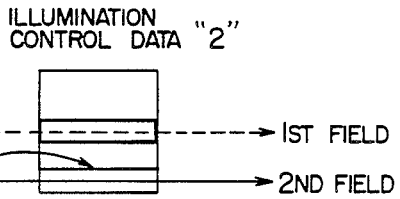
Figure 23B:
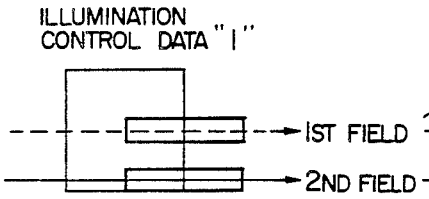
Figure 23D:
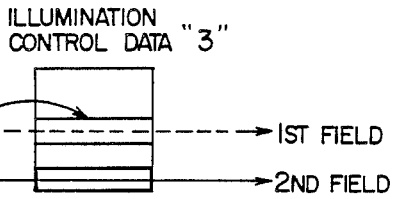

FIGS. 23A–23D show illumination status of one pixel (at $X_l$, $Y_l$) on the CRT 123. FIG. 23A shows the illumination status when the illumination control data is "0". The current color data read from the first memory 116A is displayed in both the first field and the second field. When the illumination data is "1" (FIG. 23B), the current color data is displayed on both the first field and the second field with ½ pixel position shifted by the shift circuit 125. When the illumination control data is "2" (FIG. 23C), the curent color data is displayed in the first field and the one-pixel previous color data is displayed in the second field. When the illumination control data is "3" (FIG. 23D), the current color data is displayed in the second field and the one-pixel previous color data is displayed in the first field.

The operation for displaying the line ($L_1$) shown in FIG. 24A on the CRT 123 will now be explained. The line ($L_1$) has a start point coordinate $(x_0, y_0)=(1, 1)$, an X component $\Delta x=8$, a Y component $\Delta y=2$, a gradient 2/8 and an end point coordinate $(x_8, y_8)=(9, 3)$. Since $\Delta x\ (=8)>\Delta y\ (=2)$, the (AXIS) is "0" and hence "1" is held in the X increment register 4X and "$\Delta y/\Delta x=2/8=0.25$" is held in the Y increment register 4Y. Accordingly, the X coordinates of the points $(x_1, y_1)$, $(x_2, y_2)$, . . . $(x_8, y_8)$ are obtained by sequentially adding "1" to the start point coordinate "1", and the Y coordinates are obtained by sequentially adding "0.25" to the start point coordinate "1". (See FIG. 24B.) The ($OUT_X$) and ($OUT_Y$) of the respective points are integer portions of the X and Y coordinates as shown in FIG. 24B. The fraction portions of the Y coordinates of the respective points are compared with "0.5" in the comparator 110, and if it is no smaller than "0.5", the output M is "1" , and if it is smaller than 0.5, the output M is "0". In FIG. 24B, the fraction portions of the Y coordinates of the points $(x_0, y_0)$, $(x_1, y_1)$, $(x_4, y_4)$, $(x_5, y_5)$ and $(x_8, y_8)$ are smaller than "0.5" and the output M is "0" for those points. The fraction points of the Y coordinates of the points $(x_2, y_2)$, $(x_3, y_3)$, $(x_6, y_6)$ and $(x_7, y_7)$ are larger than "0.5" and the output M is "1" for those points. The X address supplied to the frame memory 116 sequentially assumes 1, 2, 3, 4, 5, 6, 7, 8 and 9 as shown in FIG. 24B while the Y address is determined by the combination of M and (AXIS). For example, in FIG. 24B, the Y address for the point $(x_0, y_0)$ is "1" because M="0" and (AXIS)="0" (see FIG. 22), the Y address for the point $(x_1, y_1)$ is "1" because M="0" and (AXIS)=0, and the Y address for the point $(x_2, y_2)$ is first "1" and then "2" because M="1" and (AXIS)="0" (see FIG. 22).

Figure 24A:
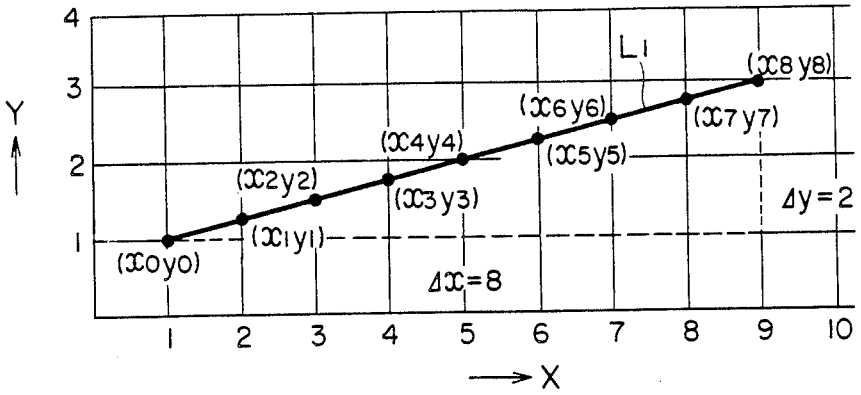
FIG. 24A shows coordinates of a line ($L_1$) displayed in the embodiment.

Since the line ($L_1$) of FIG. 24A has a positive gradient, the (SIGN) is "0", and the G, the illumination control data and the color control data at each point are determined by the combination of M and (AXIS). For example, for the point $(x_0, y_0)$, M="0", (AXIS)="0", (SEP)="0", F="0" and G="0", and hence the illumination control data is "0" and the color data is "1" (writing permitted) (see FIG. 22). For the points $(x_2, y_2)$, M="1", (AXIS)="0", (SEP)="0", F="0" and G="0" and hence the illumination control data is "3" and the color data is "0" (writing inhibited). For the point $(x_3, y_3)$, M="1", (AXIS)="0", (SEP)="0", F="1" at the end of DDA and G="1", and hence the illumination control data is "3" and the color data is "1" (writing permitted).

Figure 24C:
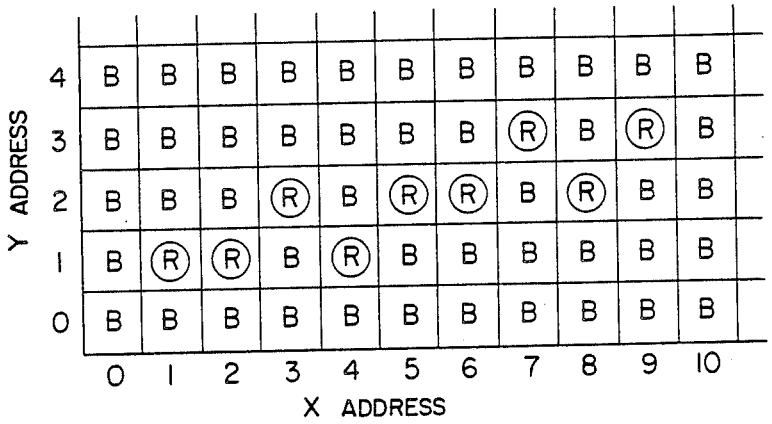
FIGS. 24C and 24D show the illumination control data and the color data stored in the frame memory.
Figure 24D:
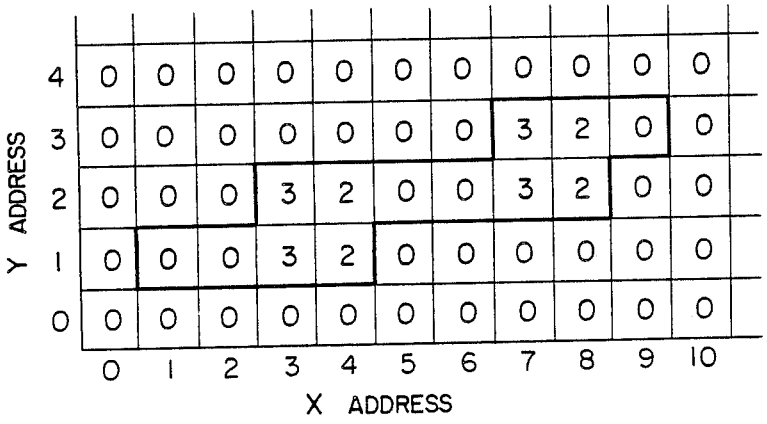

FIGS. 24C and 24D show the color data and the illumination control data stored in the first memory 116A and the second memory 116B of the frame memory 116. For the pixels for which no color is written, the color data before writing of the line (L) remain unchanged. (In the present example, the background color is blue (B) and the line (L) is displayed in red (R)).

Figure 25A:
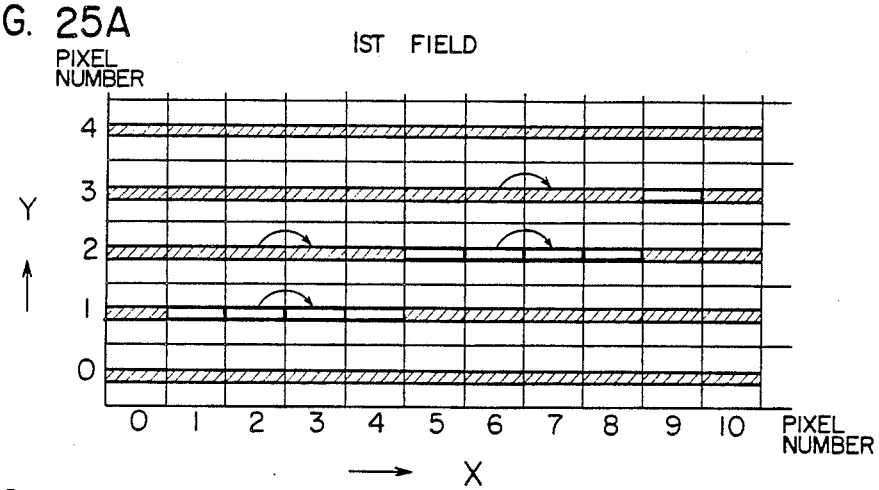
FIGS. 25A–25C show the first field and the second field of a CRT screen in the embodiment and illumination of picture cells in the first and second fields.
Figure 25B:
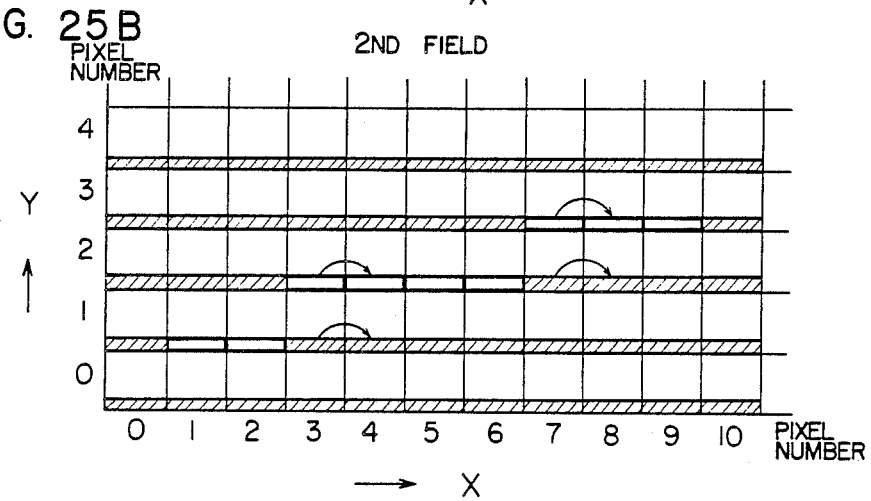
Figure 25C:
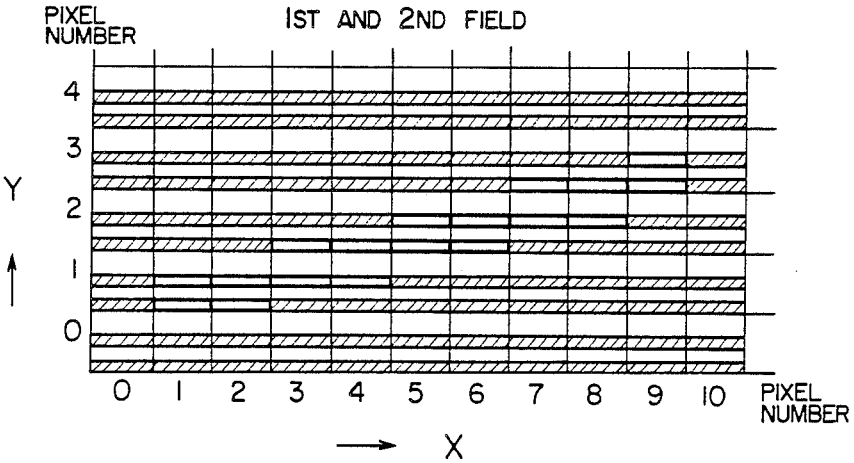

FIG. 25A shows the illumination status of the pixels on the screen of the CRT 123 in the first field. The illumination control data and the color data shown in FIGS. 24C and 24D are sequentially read out in synchronism with the raster scan and the color data is selected by the multiplexer 125 in accordance with the illumination control data so that the illumination status shown in FIG. 25A is obtained in the first field. FIG. 25B shows the illumination status in the second field and FIG. 25C shows the illumination status in the first field and the second field. (FIG. 25C is a superposition of FIGS. 25A and 25B). Hatched areas in FIG. 25 show blue illumination as the backgound color, thick framed areas show red illumination and arrows show illumination by the one-pixel previous color data held in the register 127.

Figures 26A, 26B:
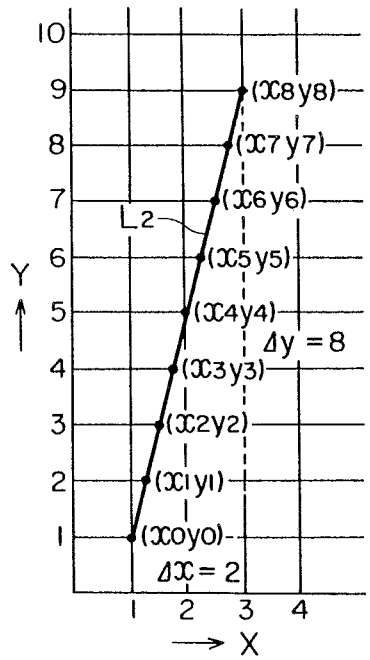
FIG. 26A shows coordinates of a line displayed in the embodiment.
FIG. 26B shows operational results of points on the line shown in FIG. 26A and the relation between the X, Y addresses, and illumination data and color control data.

The operation for displaying the line ($L_2$) shown in FIG. 26A on the CRT 123 will now be explained. The line ($L_2$) has a start point coordinate $(x_0, y_0)=(1, 1)$, an X component $\Delta x=2$, a Y component $\Delta y=8$ and a gradient ($\Delta x/\Delta y=2/8=0.25$). Since $\Delta y>\Delta x$, the (AXIS) is "1". Thus, the Y addresses are obtained by sequentially adding "1" to the start point coordinate "1" while the X addresses and the illumination control data are determined by the combination of M and (AXIS). The G does not affect the writing of the illumination control data and the color data, and the writing of the color data is always permitted.

FIGS. 26C and 26D show the color data and the illumination control data stored in the first memory 116A and the second memory 116B of the frame memory 116.

Figure 27A:
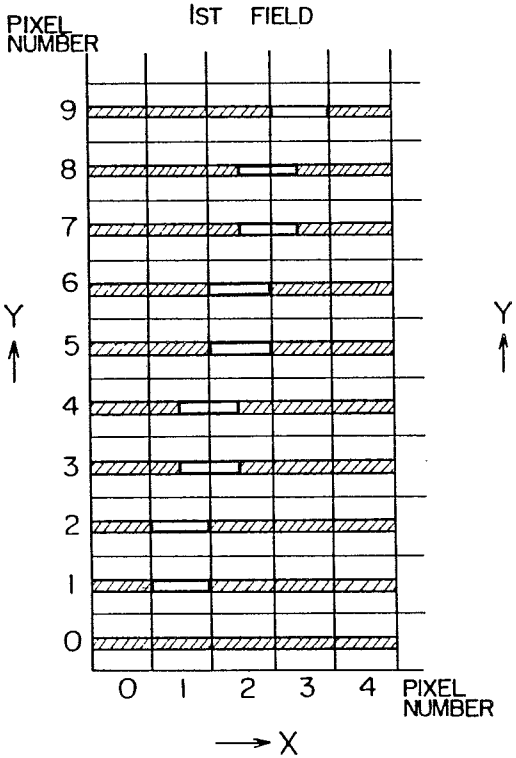
FIGS. 27A–27C show illumination of the picture cells on the CRT screen in the embodiment.
Figure 27B:
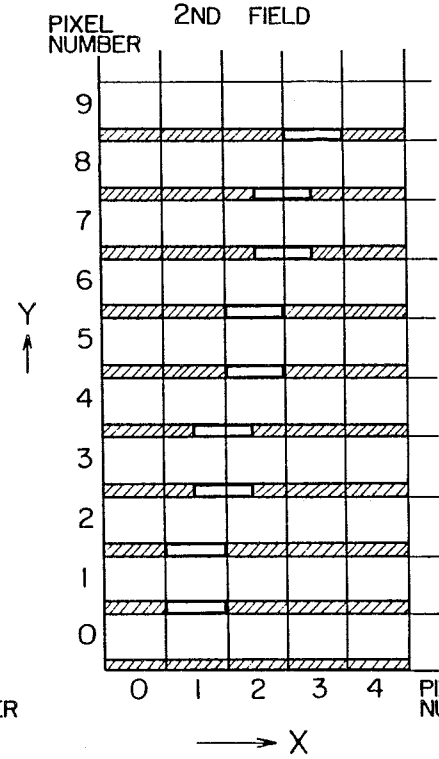
Figure 27C:
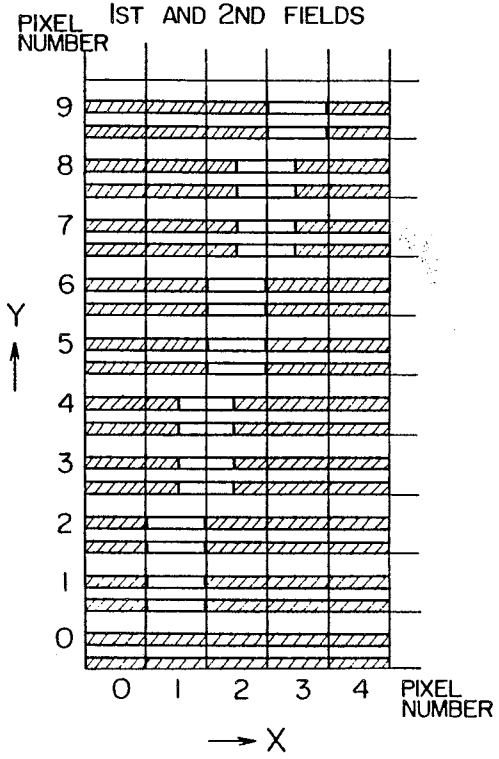

FIG. 27 shows the illumination status in the first field and the second field obtained when the illumination control data and the color data stored in the frame memory 116 as shown in FIGS. 26C and 26D are sequentially read and the multiplexer 125 and the shift circuit 126 are controlled by the illumination control data.

In the above embodiment, since the illumination and the coloring of the pixels are controlled in the first field and the second field, and the illumination positions of the pixels are shifted in the X direction, the line is displayed non-stepwise and smoothly. In the above embodiment, since each point is illuminated with the first field and the second field of the same pixel being paired or with the first field and the second field of the adjacent pixels being paired, the flickering which is likely to occur in an interlace type CRT is prevented. When the line is displayed on a colored background, the above performance is also attained.

What I claim is:

1. A graphic display control method for an interlace type CRT having a display screen having a plurality of vertically and horizontally arranged pixels and capable of illuminating said pixels in a first field and a second field, comprising the steps of:

controlling the illumination of each of the pixels in said first field and said second field in accordance with coordinate information of each point on a line to be displayed on the display screen of said interlace type CRT, and controlling shifting of the positions of the illumination of said each of the pixels in said first field and said second field; and displaying said points of said line by one of (a) a combination of the illumination in said first field and the illumination in said second field of the same pixel, (b) a combination of the illumination in said first field of a first pixel and the illumination in said second field of a second pixel located vertically adjacent to said first pixel, or a combination of the illumination in said second field of said first pixel and the illumination in said first field of said second pixel, and (c) a combination of the illumination in said first field and the illumination in said second field of the same pixel, wherein the positions of the illumination in said first field and said second field are shifted in a horizontal direction.

2. A graphic display control method according to claim 1, wherein in the display of said each of the pixels by the combination of the illumination in said first field and the illumination in said second field of the same pixel, the positions of the illumination in said first field and said second field are shifted by a half pixel in the horizontal direction.

3. A graphic display control method according to claim 1 wherein the coordinate of each of said points on said line to be displayed on the display screen of said interlace type CRT is calculated from a start point coordinate value of said line and a gradient value of said line.

4. A graphic display control method for an interlace type CRT having a display screen having a plurality of vertically and horizontally arranged pixels and capable of illuminating said pixels in a first field and a second field, comprising the steps of:

generating an X address signal, a Y address signal and an illumination control data in accordance with coordinate information of each point on a line to be displayed on the display screen of said interlace type CRT, storing said illumination control data at a specific point of a first memory designated by said X address signal and said Y address signal, and storing color data at a specific point of a second memory designated by said X address signal and said Y address signal;

controlling the illumination of each of the pixels in said first field and said second field in accordance with illumination control data subsequently read out from said first memory, and controlling the shifting of the positions of the illumination in said first field and said second field of said each of the pixels; and displaying said each of the pixels on said line by one of (a) a combination of the illumination in said first field and the illumination in said second field of the same pixel, (b) a combination of the illumination in said first field of a first pixel and the illumination in said second field of a second pixel located vertically adjacent to said first pixel, or a combination of the illumination in said second field of said first pixel and the illumination in said first field of said second pixel, and (c) a combination of the illumination in said first field and the illumination in said second field of the same pixel, wherein the positions of the illumination in said first field and said second field are shifted in a horizontal direction.

5. A graphic display control method according to claim 4 wherein said line to be displayed on the display screen of said interlaced CRT has a start point coordinate ($x_0$, $y_0$), an X component $\Delta x$ and a Y component $\Delta y$, said method further comprising a first summing step for sequentially adding "1" to the start point coordinate $x_0$ or $y_0$, and a second summing step for sequentially adding ($\Delta y/\Delta x$) to the start point coordinate $y_0$ or ($\Delta x/\Delta y$) to the start point coordinate $x_0$ in synchronism with said first summing step, an integer portion of the sum in said first summing step being used as said X address signal and an integer portion of the sum in said second summing step or a sum of said sum and "1" being used as said Y address signal.

6. A graphic display control method according to claim 4, wherein said line to be displayed on the display screen of said interlaced CRT has a start point coordinate ($x_0$, $y_0$), an X component $\Delta x$ of said line, and a Y component $\Delta y$ of said line, said method further comprising a first summing step for sequentially adding "1" to the start point coordinate $x_0$ or $y_0$, and a second summing step for sequentially adding ($\Delta y$, $\Delta x$) to the start point coordinate $y_0$ or ($\Delta x/\Delta y$) to the start point coordinate $x_0$ in synchronism with said first summing step, and wherein one of different illumination control data is generated depending on whether a fraction portion of each summed result in said second summing step is no smaller than 0.5 or not and whether said X component $\Delta x$ is larger than said Y component $\Delta y$ or not.

7. A graphic display control method according to claim 5 wherein when a fraction portion of the sum in said second summing step is no smaller than 0.5 and the X component $\Delta x$ is larger than the Y component $\Delta y$, integer portions of the sums in said first and second steps are used as said X address signal and siad Y address signal, respectively, and a first illumination control data is outputted, and when the fraction portion of the sum in said second step is smaller than 0.5 and the X component $\Delta x$ is no larger than the Y conponent $\Delta y$, the integer portion of the sum in said first summing step is used as said X address signal, a sum of an integer portion of the sum in said second summing step and "1" is used as said Y address signal and a second illumination control data is outputted.

8. A graphic display control method according to claim 5 wherein first, second, third or fourth illumination control data is produced and stored in a first memory depending on whether a fraction portion of the sum in said second summing step is no smaller than 0.5 and whether said X component $\Delta x$ is larger than said Y component $\Delta y$, the corresponding pixel is illuminated in said first field and said second field when said first illumination control data is read from said first memory, the corresponding pixel is illuminated only in said first field when said second illumination control data is read from said first memory, the corresponding pixel is illuminated only in said second field when said third illumination control data is read from said first memory, and a position of illumination is horizontally shifted by ½ pixel position when said fourth illumination control data is read from said first memory.

9. A graphic display control method according to claim 4 wherein said line to be displayed on the display screen of said interlace type CRT has a start point coordinate ($x_0$, $y_0$), an X component $\Delta x$ and a Y component $\Delta y$, said method further comprising a first summing step for sequentially adding "1" to the start point coordinate $x_0$ or $y_0$, and a second summing step for sequentially adding ($\Delta y/\Delta x$) to the start point coordinate $y_0$ or ($\Delta x/\Delta y$) to the start point coordinate $x_0$ in synchronism with said first summing step, and wherein each summed result in said first summing step is used as said X address signal, and a rounded number of a fraction portion of each summed result in said second summing step or a number equal to said rounded number less "1" is used as said Y address signal.

10. A graphic display control method according to claim 4 wherein said line to be displayed on the display screen of said interlace type CRT has a start point coordinate ($x_0$, $y_0$), an X component $\Delta x$ of said line, and a Y component $\Delta y$ of said line, said method further comprising a first summing step for sequentially adding "1" to the start point coordinate $x_0$ or $y_0$, and a second summing step for sequentially adding ($\Delta y/\Delta x$) to the start point coordinate $y_0$ or ($\Delta x/\Delta y$) to the start point coordinate $x_0$ in synchronism with said first step, and wherein one of different illumination control data is generated depending on whether the fraction portion of each summed result in said second summing stop is no smaller than 0.5 or not and whether said X component $\Delta x$ is larger than said Y component $\Delta y$.

11. A graphic display control method according to claim 9 wherein when the fraction portion of the sum in said second summing step is smaller than 0.5 and said X component $\Delta x$ is larger than said Y component $\Delta y$, the rounded numbers of the fraction portions of the sums in said first and second summing steps are used as said X address signal and said Y address signal, respectively, and a first illumination control data is outputted, and when the fraction portion of the sum in said second summing step is not smaller than 0.5 and said X component $\Delta x$ is larger than said Y component $\Delta y$, the rounded number of the fraction portion of the sum in said first summing step is used as said X address signal, a number equal to the rounded number of the fraction portion of the sum in said second summing step less "1" is used as said Y address signal and a second illumination control data is outputted.

12. A graphic display control method according to claim 9 wherein first, second, third or fourth illumination control data is produced and stored in a first memory depending on whether a fraction portion of the sum in said second summing step is no smaller than 0.5 and whether said X component $\Delta x$ is larger than said Y component $\Delta y$, the corresponding pixel is illluminated in said first field and said second field when said first illumination control data is read from said first memory, the corresponding pixel is illuminated only in said second field when said second illumination control data is read from said first memory, the corresponding pixel is illuminated only in said first field when said third illumination control data is read from said first memory, and the position of illumination is horizontally shifted by ½ pixel position when said fourth illumination control data is read from said first memory.

13. A graphic display control method according to claim 4 wherein said line to be displayed on the display screen of said interlaced CRT has a start point coordinate ($x_0$, $y_0$), an X component $\Delta x$ and a Y component $\Delta y$, said method further comprising a first summing step for sequentially adding "1" to the start point coordinate $x_0$ or $Y_0$, and a second summing step for sequentially adding ($\Delta y/\Delta x$) to the start point coordinate $y_0$ or ($\Delta x/\Delta y$) to the start point coordinate $x_0$ in synchronism with said first summing step, and wherein an integer portion of each summed result in said first summing step is used as said X address signal and an integer portion of each summed result in said second summing step or the sum of said each integer portion and "1" is used as said Y address signal.

14. A graphic display control method according to claim 13 wherein one of different illumination control data and one of different color control data are generated depending on whether a fraction portion of the sum in said second summing step is no smaller than 0.5 or not and whether said X component $\Delta x$ is larger than said Y component $\Delta y$ or not.

15. A graphic display control method according to claim 4, wherein one of first, second, third and fourth illumination control data is stored at the address of said first memory designated by said X address signal and said Y address signal, and a color data specified by a first or second color control data is stored at the address of said second memory designated by said X address signal and said Y address signal.

16. A graphic display control method according to claim 15 wherein when said first color control data is generated, the specified color data is stored at the address of said second memory designated by said X address signal and said Y address signal, and when said second color control data is generated, the specified data is not stored at the address of said second memory designated by said X address signal and said Y address signal.

17. A graphic display control method according to claim 15 wherein said first illumination control data is read from said first memory, the corresponding pixel is illuminated in said first field and said second field in accordance with the color data read from said second memory.

18. A graphic display control method according to claim 15 wherein when said second illumination control data is read from said first memory, the corresponding pixel is illuminated in said first field and said second field in accordance with the color data read from said second memory and the position of illumination is horizontally shifted by ½ pixel position.

19. A graphic display control method according to claim 15 wherein when said third illumination control signal is read from said first memory, the corresponding pixel is illuminated in accordance with the color data read from said second memory in said first field and in accordance with the immediately previous color data in said second field.

20. A graphic display control method according to claim 15 wherein when said fourth illumination control signal is read from said first memory, the corresponding pixel is illuminated in accordance with the color data read from said second memory in said second field and in accordance with the immediately previous color data in said first field.

21. A graphic display control method for an interlace type CRT having a display screen having a plurality of vertically and horizontally arranged pixels and capable of illuminating said pixels in a first field and a second field, comprising the steps of:

controlling the illumination and coloring of the pixel in said first field and said second field in accordance with coordinate information of each point on a line to be displayed on the display screen of said interlace type CRT, and controlling shifting of the positions of the illumination in said first field and said second field of said each of the pixels; and displaying said each of the pixels on said line by one of (a) a combination of the illumination in said first field and and the illumination in said second field of the same pixel, (b) a combination of the illumination in said first field of a first pixel and the illumination in said second field of a second pixel located vertically adjacent to said first pixel, or a combination of the illumination in said second field of said first pixel and the illumination in said first field of said second pixel, and (c) a combination of the illumination in said first field and the illumination in said second field of the same pixel, wherein the positions of the illumination in said first field and said second field are shifted in a horizontal direction.

22. A graphic display control apparatus comprising an interlace type CRT having a display screen having a plurality of vertically and horizontally arranged pixels and capable of illuminating said pixels in a first field and a second field;

signal generating means for generating an X address and a Y address in accordance with coordinate information of each of points of a line to be displayed on the display screen of said interlace type CRT, and for generating an illumination control data which determines whether or not a pixel is illuminated in said first field and said second field, or whether or not two pixels arranged in the vertical direction are illuminated in said first field or said second field;

a frame memory for storing a color data and said illumination control data at an address designated by said X address and said Y address supplied by said signal generating means, said color data being supplied from a processor and used for displaying in color;

control means for controlling the color data read from said frame memory in accordance with the illumination control data read from said frame memory in synchronism with a raster scan of said interlace type CRT; and means for supplying the color data controlled by said control means to said interlace type CRT to display said line on said display screen, wherein each point on a line to be displayed on the display screen of said interlace type CRT is displayed by one of (a) a combination of the illumination in said first field and the illumination in said second field of the same pixel, (b) a combination of the illumination in said first field of a first pixel and the illumination in said second field of a second pixel located vertically adjacent to said first pixel, or a combination of the illumination in said second field of said first pixel and the illumination in said first field of said second pixel, and (c) a combination of the illumination in said first field and the illumination in said second field of the same pixel, wherein the positions of the illumination in said first field and said second field are shifted in a horizontal direction.

23. A graphic display control apparatus according to claim 22 wherein said signal generating means calculates the coordinates of the respective points of the line to be displayed on the display screen of said interlace type CRT and generates said X address, said Y address and said illumination control data in accordance with the result of the calculation of the coordinates and the magnitude relationship between an X component and a Y component of said line.

24. A graphic display control apparatus according to claim 22 wherein said line to be displayed on the display screen of said interlace type CRT has a start point coordinate ($x_0$, $y_0$), an X component $\Delta x$ of said line to be displayed on the display screen of said CRT and a Y component $\Delta y$ of said line to be displayed on the display screen of said CRT, said signal generating means including:

first summing means for sequentially adding "1" to the start point coordinate $x_0$ or $y_0$;

second summing means for sequentially adding ($\Delta y/\Delta x$) to the start point coordinate $y_0$ or ($\Delta x/\Delta y$) to the start point coordinate $x_0$ in sychronism with said first summing means;

first and second integer means for outputting integer portions of the sums produced by said first and second summing means, respectively;

first compare means for comparing said X component $\Delta x$ and said Y component $\Delta y$;

second compare means for comparing a fraction portion of the sum produced by said first or second summing means with a predetermined value;

third summing means for adding "1" to the output of said second integer means;

selection means for selecting the output of said second integer means or the output of said third summing means depending on the compare results by said first and second compare means; and illumination control data generation means for generating the illumination control data in accordance with the compare results of said first and second compare means.

25. A graphic display control apparatus comprising:

an interlace type CRT having a display screen having a plurality of vertically and horizontally arranged pixels and capable of illuminating said pixels in a first field and a second field;

address signal generating means for generating an X address, and a Y address in accordance with coordinate information of each of points of a line to be displayed on the display screen of said interlace type CRT;

control data generating means for generating an illumination control data which determines whether or not a pixel is illuminated in said first field and said second field, or whether or not two pixels arranged in the vertical direction are illuminated in said first field or said second field in accordance with said coordinate information;

color data control means for permitting or inhibiting writing of a color data to an address of a first memory designated by said address signal generating means in accordance with said color control data;

a second memory for storing said illumination control data at an address designated bysaid address signal generating means;

selection means for selecting the color data read from said first memory in accordance with the illumination control data read from said second memory in synchronism with a raster scan of said interlace type CRT; and means for shifting said color data in an X direction in accordance with the illumination control data read from said second memory, wherein each point on a line to be displayed on the display screen of said interlace type CRT is displayed by one of (a) a combination of the illumination in said first field and the illumination in said second field of the same pixel, (b) a combination of the illumination in said first field of a first pixel and the illumination in said second field of a second pixel located vertically adjacent to said first pixel, or a combination of the illumination in said second field of said first pixel and the illumination in said first field of said second pixel, and (c) a combination of the illumination in said first field and the illumination in said second field of the same pixel, wherein the positions of the illumination in said first field and said second field are shifted in a horizontal direction.

26. A graphic display control apparatus for displaying a line on an interlace-type monochrome CRT having a display screen with a plurality of vertically and horizontally arranged pixels, each of the pixels having first and second fields that can be illuminated, comprising:

first means for determining a set of pixels which lie along the line; and second means, cooperating with the first means, for smoothly displaying the line on the CRT by selectively illuminating at least one field of each pixel in the set, the second means including third means for selectively illuminating both fields of a pixel in the set, fourth means for selectively shifting a pixel of the set horizontally and illuminating both fields thereof, and fifth means for selectively illuminating one field of each of a pair of vertically adjacent pixels in the set, the second field but not the first field being illuminated in the top pixel of the pair and the first field but not the second field being illuminated in the bottom pixel of the pair, wherein each point on a line to be displayed on the display screen of said interlace type CRT is displayed by one of (a) a combination of the illumination in said first field and the illumination in said second field of the same pixel, (b) a combination of the illumination in said first field of a first pixel and the illumination in said second field of a second pixel located vertically adjacent to said first pixel, or a combination of the illumination in said second field of said first pixel and the illumination in said first field of said second pixel, and (c) a combination of the illumination in said first field and the illumination in said second field of the same pixel, wherein the positions of the illumination in said first field and said second field are shifted in a horizontal direction.

27. A graphic display control apparatus for displaying a line on an interlace-type color CRT having a display screen with a plurality of vertically and horizontally arranged pixels, each pixel having first and second fields that can be illuminated in a plurality of colors, comprising:

first means for determining a set of pixels which lie along the line; and second means, cooperating with the first means, for smoothly displaying the line in a predetermined color on the CRT by selectively illuminating, in the predetermined color, at least one field of each pixel in the set, the second means including third means for selectively illuminating both fields of a pixel in the set in the predetermined color, fourth means for selectively shifting a pixel of the set horizontally and illuminating both fields thereof in the predetermined color, and fifth means for selectively illuminating one field of each of a pair of vertically adjacent pixels in the set in the predetermined color, the second field but not the first field being illuminated in the predetermined color in the top pixel of the pair and the first field but not the second field being illuminated in the predetermined color in the bottom pixel of the pair, wherein each point on a line to be displayed on the display screen of said interlace type CRT is displayed by one of (a) a combination of the illumination in said first field and the illumination in said second field of the same pixel, (b) a combination of the illumination in said first field of a first pixel and the illumination in said second field of a second pixel located vertically adjacent to said first pixel, or a combination of the illumination in said second field of said first pixel and the illumination in said first field of said second pixel, and (c) a combination of the illumination in said first field and the illumination in said second field of the same pixel, wherein the positions of the illumination in said first field and said second field are shifted in a horizontal direction.

* * * * *